US011837165B2

(12) United States Patent
Furukawa

(10) Patent No.: US 11,837,165 B2
(45) Date of Patent: Dec. 5, 2023

(54) DISPLAY DEVICE FOR REPAIRING A DEFECTIVE PIXEL CIRCUIT AND DRIVING METHOD THEREOF

(71) Applicant: SHARP KABUSHIKI KAISHA, Sakai (JP)

(72) Inventor: Tomoo Furukawa, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 95 days.

(21) Appl. No.: 17/602,997

(22) PCT Filed: Apr. 19, 2019

(86) PCT No.: PCT/JP2019/016842
§ 371 (c)(1),
(2) Date: Oct. 11, 2021

(87) PCT Pub. No.: WO2020/213157
PCT Pub. Date: Oct. 22, 2020

(65) Prior Publication Data

US 2022/0122538 A1 Apr. 21, 2022

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2310/0278* (2013.01)

(58) Field of Classification Search
CPC ..... G09G 3/3233
USPC ..... 345/204
See application file for complete search history.

(56) References Cited

U.S. PATENT DOCUMENTS

2009/0102758 A1 4/2009 Anzai et al.
2017/0316737 A1* 11/2017 Park ..... G09G 3/3208
2019/0213958 A1* 7/2019 Cho ..... G09G 3/3233
2020/0403049 A1* 12/2020 Moon ..... H10K 59/1216

FOREIGN PATENT DOCUMENTS

JP 2009-134246 A 6/2009

* cited by examiner

*Primary Examiner* — Long D Pham
(74) *Attorney, Agent, or Firm* — ScienBiziP, P.C.

(57) ABSTRACT

From a back side of an insulating substrate 90, a laser beam is applied to a spot where an initialization line Vini is superimposed on the semiconductor layer SI that serves as a first conductive terminal of a second initialization transistor T7 while sandwiching an insulating film therebetween. Thus, a gate insulating film 91 and a first interlayer insulating film 92, which are sandwiched between the semiconductor layer SI and the initialization line Vini, disappear by evaporation, and a laser irradiation area LA of the semiconductor layer SI is connected to the initialization line Vini, by which a connection portion CP is formed. As a result, a voltage to be applied to the organic EL element OLED becomes equal to or less than a threshold voltage. Therefore, the organic EL element OLED is constantly in a lighting-off state, and the pixel circuit 11 is constantly kept black.

12 Claims, 18 Drawing Sheets

(a)

(b)

(c)

DISPLAY DEVICE FOR REPAIRING A DEFECTIVE PIXEL CIRCUIT AND DRIVING METHOD THEREOF

TECHNICAL FIELD

The following disclosure relates to a display device and a method for manufacturing the same, and more specifically, relates to a display device including an electro-optical element to be driven by a current, such as an organic electro luminescence (EL) display device, and to a method for manufacturing the same.

BACKGROUND ART

As a display device provided with features such as thinness, high image quality and low power consumption, an organic EL display device has attracted attention, and at present, development thereof is being actively promoted. A display panel that displays an image in the organic EL display device includes: a display unit in which a plurality of pixel circuits are arranged; and a picture-frame in which a drive circuit that drives the respective pixel circuits is disposed.

The pixel circuit includes a plurality of transistors. If all of these transistors operate normally, then the pixel circuit emits light with a brightness corresponding to a data signal, and displays an image on the display panel. However, the pixel circuit including a transistor that has stopped operating normally becomes a black dot, for example, by an organic EL element turning to a constantly lighting-off state or becomes a bright point by the organic EL element turning to a constantly lighting-on state. Moreover, in some cases, an abnormal tone occurs by the pixel circuit emitting light with a brightness different from the brightness corresponding to the data signal or a line defect is displayed on the display due to occurrence of an abnormal tone in a plurality of continuous pixel circuits.

A display panel in which the pixel circuit having such defect is repaired to be turned to the constantly lighting-off state and is thereby turned to the black dot is not regarded as a problem in practical use, in many cases, if the number of defects is small. Accordingly, if such a repair to turn the pixel circuit having a defect to a black dot can be carried out, then manufacturing yield of the display panel can be improved. Accordingly, it becomes possible to reduce manufacturing cost of the display panel.

The following repair method is disclosed in Patent Document 1. Each pixel circuit is divided into a plurality of regions, and an organic EL element is provided for each of the regions one by one. When the pixel circuit with such a configuration is not normally turned on, the organic EL elements included in the pixel circuit are sequentially turned to an ON state to inspect whether or not they are turned on. As a result, if there is an organic EL element that is not turned on, then a wire connected to the organic EL element is fused by being irradiated with a laser beam and the organic EL element is cut off from the pixel circuit.

PRIOR ART DOCUMENT

Patent Document

[Patent Document 1] Japanese Laid-Open Patent Publication No. 2009-134246

SUMMARY

Problems to be Solved by the Invention

However, it is difficult to divide each pixel circuit into the plurality of regions, to provide the organic EL element for each of the divided regions, and to surely fuse only the organic EL element that does not emit light so as not to affect the organic EL elements which emit light normally. Moreover, when a metal wiring layer is fused by being irradiated with the laser beam, it is necessary to apply a laser beam with a large output. However, when the metal wiring layer is fused, a part of the fused wiring layer adheres to another spot, which may result in a cause of a failure.

In this connection, an object of the following disclosure is to provide a display device capable of being subjected to a repair for easily and surely turning a pixel circuit to a black dot, and to provide a method for manufacturing the same.

Means for Solving the Problems

A display device according to a first aspect is directed to a display device that displays an image by supplying a data signal individually to a plurality of pixel circuits arranged on a display panel, the display device including:

- a plurality of data lines to which the data signal is supplied;
- a plurality of scanning lines to which scanning signals for selecting pixel circuits are sequentially supplied;
- the plurality of pixel circuits provided so as to correspond to intersections of the plurality of data lines and the plurality of scanning lines;
- a scanning line drive circuit configured to sequentially select the plurality of scanning lines; and
- a data line drive circuit configured to supply the data signal to the plurality of data lines, wherein
- each of the plurality of pixel circuits includes:
- an electro-optical element;
- a drive transistor for supplying a drive current corresponding to the data signal to the electro-optical element;
- compensation transistor for compensating for a threshold voltage of the drive transistor by writing the data signal that is given from a corresponding data line into a node connected to a control terminal of the drive transistor;
- an initialization line configured to supply an initialization potential;
- a first initialization transistor that has a first conductive terminal connected to the node and a second conductive terminal connected to the initialization line; and
- a second initialization transistor that has a first conductive terminal connected to a first electrode of the electro-optical element and a second conductive terminal connected to the initialization line, and
- in at least one pixel circuit among the plurality of pixel circuits, the first conductive terminal of the second initialization transistor and the initialization line are electrically connected to each other.

A method for manufacturing a display device according to an eleventh aspect is directed to a method for manufacturing a display device that displays an image by supplying a data signal individually to a plurality of pixel circuits formed on a display panel, wherein

- each of the plurality of pixel circuits includes:
- an electro-optical element that emits light with a brightness corresponding co a current value of a drive current corresponding to the data signal;

a drive transistor for supplying the drive current to the electro-optical element;

compensation transistor for compensating for a threshold voltage of the drive transistor by writing the data signal that is given from a data line into a node connected to a control terminal of the drive transistor;

initialization line configured to supply an initialization potential;

a first initialization transistor that has a first conductive terminal connected to the node and a second conductive terminal connected to the initialization line; and a second initialization transistor that has a first conductive terminal connected to a first electrode of the electro-optical element and a second conductive terminal connected to the initialization line, and the method includes a step of electrically connecting the first conductive terminal of the second initialization transistor and the initialization line to each other by irradiating at least a part of a region where the first conductive terminal of the second initialization transistor is superimposed on the initialization with a laser beam from a back side of the display panel, in at least one pixel circuit among the plurality of pixel circuits.

A method for manufacturing a display device according to a twelfth aspect is directed to a method for manufacturing a display device that displays an image by supplying a data signal individually to a plurality of pixel circuits formed on a display panel, wherein each of the plurality of pixel circuits includes:

an electro-optical element that emits light with a brightness corresponding to a current value of a drive current corresponding to the data signal;

a drive transistor for supplying the drive current to the electro-optical element;

a compensation transistor for compensating for a threshold voltage of the drive transistor by writing the data signal that is given from a data line into a node connected to a control terminal of the drive transistor;

an initialization line configured to supply an initialization potential;

a first initialization transistor that has first conductive terminal connected to the node and a second conductive terminal connected to the initialization line;

a second initialization transistor that has a first conductive terminal connected to a first electrode of the electro-optical element and a second conductive terminal connected to the initialization line; and a connection wire electrically connected to the initialization line and formed to be superimposed on a semiconductor layer as the first conductive terminal of the second initialization transistor with an insulating film interposed between the connection wire and the semiconductor layer, and the method includes a step of, in at least one pixel circuit among the plurality of pixel circuits, electrically connecting the first conductive terminal of the second initialization transistor and the initialization line to each other by electrically connecting the first conductive terminal of the second initialization transistor and the connection wire to each other by irradiating at least a part of a region where the connection wire is superimposed on the semiconductor layer with a laser beam from a back side of the display panel.

Effects of the Invention

According to the first aspect, the semiconductor layer that serves as the first conductive terminal of the initialization transistor and the initialization line are electrically connected to each other. Thus, the initialization potential applied to the first electrode of the electro-optical element, and accordingly, the voltage to be applied to the electro-optical element becomes equal to or less than the threshold voltage. As a result, even if the pixel circuit causes an operation failure, the electro-optical element is constantly in a lighting-off state, and the pixel circuit is constantly kept black.

According to the eleventh aspect, at least a part of the region where the initialization line is superimposed on the semiconductor layer is irradiated with the laser beam, whereby the repair can be performed without fusing the initialization line by the laser beam.

According to the twelfth aspect, the whole of the region where the connection wire connected to the initialization line is superimposed on the semiconductor layer can be irradiated with the laser beam, and accordingly, the repair to connect the initialization line to the semiconductor layer can be surely performed.

MODES FOR CARRYING OUT THE INVENTION

Embodiments of the present disclosure will be described below with reference to the accompanying drawings. Note that "connection" in the present description means "electrical connection" unless otherwise noted, and within the scope without departing from the spirit of the present disclosure, includes not only a case of meaning a direct connection but also an indirect connection via another element.

1. First Embodiment

1.1 Configuration of Organic EL Display Device

Figure 1:
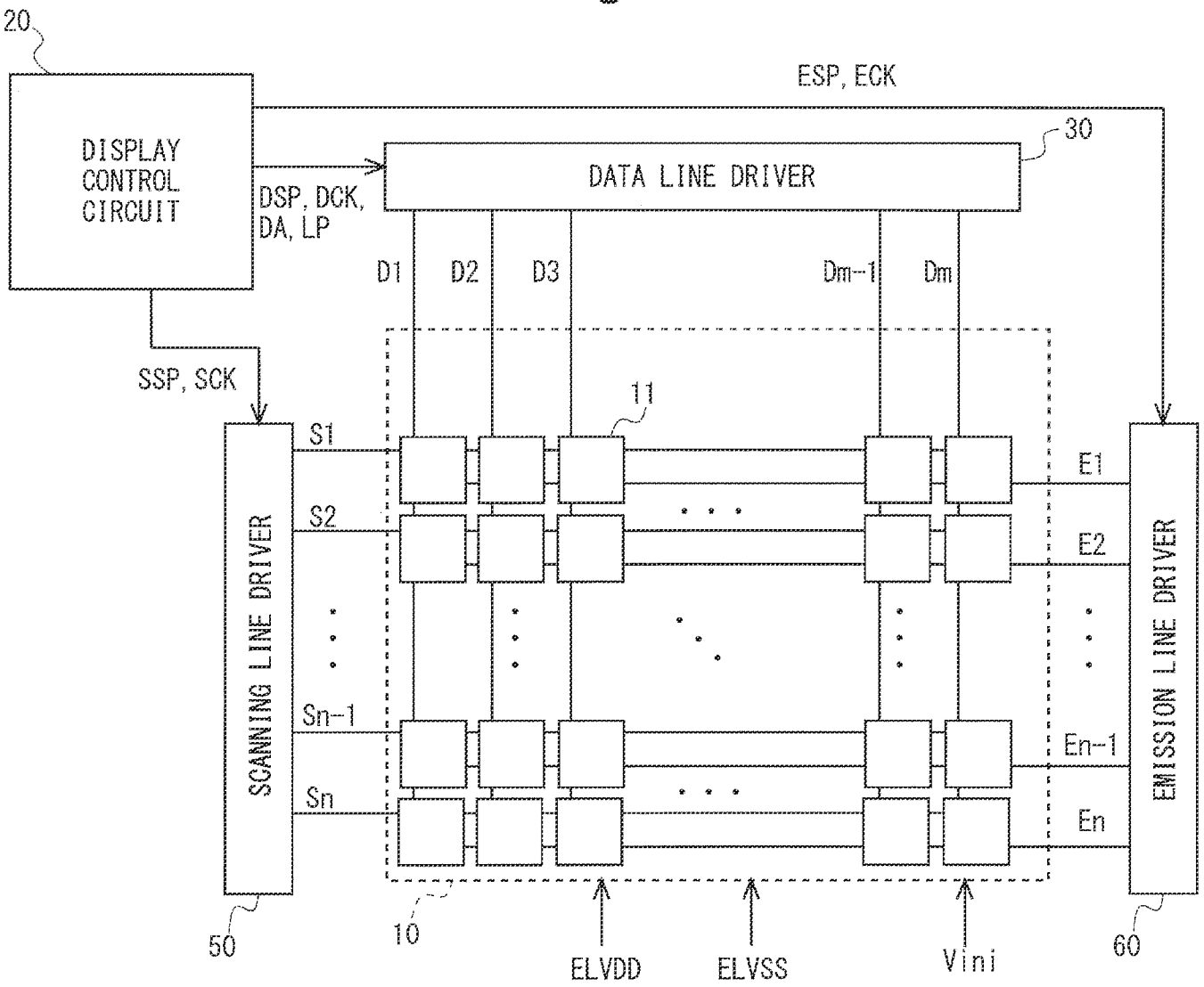
FIG. 1 is a block diagram illustrating an overall configuration of an organic EL display device according to a first embodiment.

FIG. 1 is a block diagram illustrating an overall configuration of an organic EL display device according to a first embodiment. As illustrated in FIG. 1, the organic EL display device (hereinafter, simply referred to as a "display device") includes: a display unit 10; a display control circuit 20; a data line driver 30; a scanning line driver 50; and an emission line driver 60. The organic EL display device illustrated in FIG. 1 directly supplies data signals from the data line driver 30 to respective data lines. In the present embodiment, a data line drive circuit is achieved by the data line driver 30, a scanning line drive circuit is achieved by the scanning, line driver 50, and a light emission control line drive circuit is achieved by the emission line driver 60.

In the display unit 10, m (m is an integer of 2 or more) pieces of data lines D1 to Dm and n (n is an integer of 2 or more) pieces of scanning lines S1 to Sn are arranged. Moreover, in the display unit 10, a pixel circuit 11 is provided for each of intersections of the respective data lines and the respective scanning lines. More specifically, m×n pieces of the pixel circuits 11 are provided so as to individually correspond to the intersections of the m pieces of data lines D1 to Dm and the n pieces of scanning lines S1 to Sn.

In the display unit 10, emission lines E1 to En as n pieces of light emission control lines are further arranged in parallel to the n pieces of scanning lines S1 to Sn. The m pieces of data lines D1 to Dm are connected to the data line driver 30. The n pieces of scanning lines S1 to Sn are connected to the scanning line driver 50. The n pieces of emission lines E1 to En are connected to the emission line driver 60.

Moreover, in the display unit 10, power supply lines (not illustrated) common to the respective pixel circuits 11 are arranged. More specifically, arranged are: a power supply line (hereinafter, referred to as a "high-level power supply line" or a "first power supply line", and denoted by reference symbol ELVDD in the same way as a high-level potential ELVDD) configured to supply the high-level potential (also referred to as a "first power supply potential") ELVDD for driving later-described organic EL elements (also referred to as "electro-optical elements"); and a power supply line (hereinafter, referred to as a "low-level power supply line" or a "second power supply line", and denoted by reference symbol ELVSS in the same way as a low-level potential ELVSS configured to supply the low-level potential (also referred to as a "second power supply potential") ELVSS for driving the organic EL elements. Moreover, arranged is an initialization line Vini (denoted by reference symbol Vini in the same way as an initialization potential) configured to supply the initialization potential Vini for performing initialization operations to be described later. These potentials are supplied from a power supply circuit (not illustrated).

The display control circuit 20 outputs a variety of control signals to the data line driver 30, the scanning line driver 50, and the emission line driver 60. More specifically, the display control circuit 20 outputs a data start pulse DSP, a data clock DCK, display data DA, and a latch pulse LP to the data line driver 30. The display control circuit 20 outputs a scanning start pulse SSP and a scanning clock SCK to the scanning line driver 50. The display control circuit 20 further outputs an emission start pulse ESP and an emission clock ECK to the emission line driver 60.

The data line driver 30 includes an m-bat shift register, a sampling circuit, a latch circuit, m pieces of D/A converters, and the like, all of which are not illustrated. The shift register has m pieces of bistable circuits connected to one another in a cascade fashion, transfers the data start pulse DSP, which is supplied to an initial stage thereof, in synchronization with the data clock DCK, and outputs sampling pulses from respective stages. The display data DA is supplied to the sampling circuit in synchronization with output timing of the sampling pulse. The sampling circuit stores the display data DA in accordance with the sampling pulse. When the display data an for one line is stored in the sampling circuit, the display control circuit 20 outputs the latch pulse LP to the latch circuit. Upon receiving the latch pulse LP, the latch circuit holds the display data DA stored in the sampling circuit. The D/A converters are provided corresponding to the m pieces of data lines D1 to Dm individually connected to m pieces of output terminals (not illustrated) of the data line driver 30, convert the display data DA, which is held in the latch circuit, into data signals which are analog signal voltages, and output the obtained data signals individually to the data lines D1 to Dm.

The scanning line driver 50 drives the n pieces of scanning lines S1 to Sn. More specifically, the scanning line driver 50 includes a shift register, a buffer and the like, all of which are not illustrated. The shift register sequentially transfers the scanning start pulse SSP in synchronization with the scanning clock SCK. Scanning signals which are outputs from respective stages of the shift register are sequentially suppled to the corresponding scanning lines S1 to Sn via buffers. By an active scanning signal (a low-level scanning signal in the present embodiment), m pieces of pixel circuits 11 connected to scanning lines Sj (j=1 to n) are collectively selected.

The emission line driver 60 drives n pieces or emission lines E1 to En. More specifically, the emission line driver 60 includes a shift register, a buffer and the like, all of which are not illustrated. The shift register sequentially transfers the emission start pulse ESP in synchronization with the emission clock ECK. Emission signals which are outputs from respective stages of the shift register are supplied to the corresponding emission lines Ej (j=1 to n) via buffers.

Although FIG. 1 illustrates, as an example, the organic EL display device in which the scanning line driver 50 is disposed on one end side (left side of the display unit 10 in FIG. 1) of the display unit 10 and the emission line driver 60 is disposed on other end side (right side of the display unit 10 in FIG. 1) of the display unit 10, the configuration is not limited to this. For example, there may be adopted a double-sided input structure in which both of the scanning line driver 50 and the emission line driver 60 are disposed on both sides. Moreover, in order to reduce the number of output terminals of the data line driver 30, a demultiplexer unit may be provided between the data line driver 30 and the respective pixel circuits. In this case, the data line driver 30 drives the data lines D1 to Dm by a drive system called source shared driving (SSD) of supplying output data signals to respective data lines via the demultiplexer unit.

1.2 Configuration of Pixel Circuit

Figure 2:
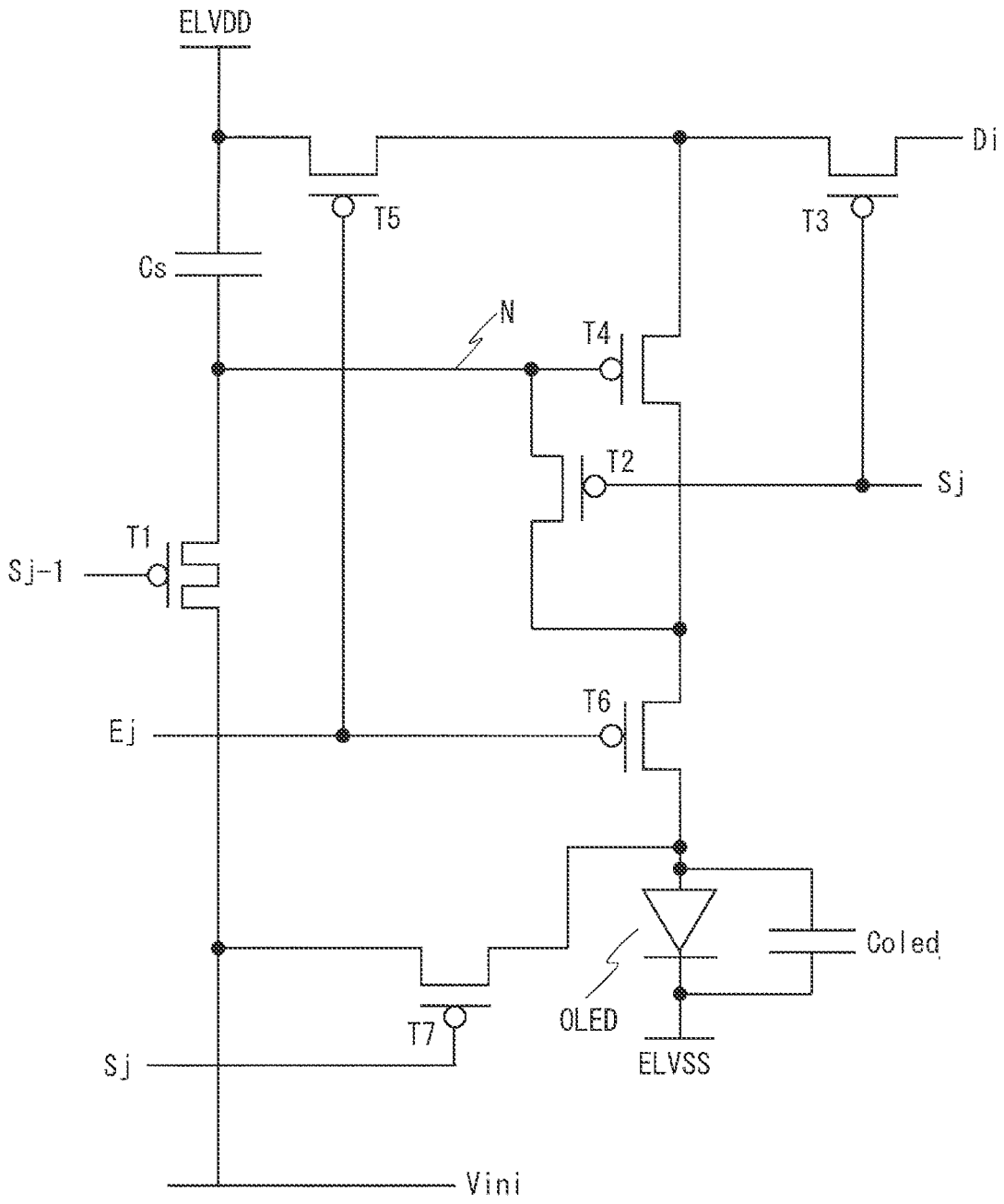
FIG. 2 is a circuit diagram illustrating a configuration of a pixel circuit formed in a display unit of the organic EL display device illustrated in FIG. 1.

A configuration of the pixel circuit 11 will be described. FIG. 2 is a circuit diagram illustrating the configuration of the pixel circuit 11 formed in the display unit 10. As illustrated in FIG. 2, the pixel circuit 11 includes: one organic EL element OLED; seven p channel-type transistors T1 to T7; and one storage capacitor Cst (also referred to as "holding capacitance"). More specifically, the pixel circuit 11 includes the first initialization transistor (also referred to as a "node initialization transistor") T1, the compensation transistor T2, the write transistor T3, the drive transistor T4, the power supply transistor T5, the light emission control transistor T6, and the second initialization transistor T7. Note that, in the present description, in some cases, a pixel circuit that displays a bright point with a brightness corresponding to a data signal is called a "first pixel circuit," and a pixel circuit that constantly displays a black state is called a "second pixel circuit."

The drive transistor T4 includes a gate terminal (control terminal), a first conductive terminal, and a second conductive terminal. The first conductive terminal of the drive transistor T4 is a conductive terminal to be connected to the high-level power supply line ELVDD via the power supply transistor T5, and the second conductive terminal thereof is a conductive terminal to be connected to the organic EL element OLED via the light emission control transistor T6. In the drive transistor T4, in response to a flow of carriers, the first conductive terminal and the second conductive terminal become a source terminal and a drain terminal, respectively, or become the drain germinal and the source terminal, respectively. Specifically, when holes as the carriers flow from the first conductive terminal to the second conductive terminal, the first conductive terminal becomes the source terminal, and the second conductive terminal becomes the drain terminal. On the contrary, when the holes flow from the second conductive terminal to the first conductive terminal, the second conductive terminal becomes the source terminal, and the first conductive terminal becomes the drain terminal.

In the pixel circuit 11, arranged are the scanning lines Sj (j is an integer between 1 and n both inclusive), a previous scanning line Sj−1 (also referred to as a "discharge line"), the emission line Ej, the data line Di (i is an integer between 1 and m both inclusive), the high-level power supply line ELVDD, the low-level power supply line ELVSS, and the initialization line Vini. The write transistor T3 has the gate terminal, connected to the scanning line Sj, has the first conductive terminal connected to the data line Di, and supplies the data signal, which is supplied to the data line Di, to the first conductive terminal or the drive transistor T4 in response to the selection of the scanning line Sj.

The first conductive terminal of the drive transistor is connected to the second conductive terminal of the write transistor T3, and the gate terminal thereof is connected to a node N. The node N is a nodal point (also referred to as a "node") at which a second conductive terminal of the compensation transistor T2 to be described later and a first terminal of the storage capacitor Cst are connected to each other, and is charged with a voltage (data voltage) of the data signal to be given to the gate terminal of the drive transistor T4. The drive transistor T4 supplies a drive current, which is determined in response to the data voltage charged to the node N, to the organic EL element OLED.

A gate terminal (control terminal) of the compensation transistor T2 is connected to the scanning line Sj. When the scanning line Sj becomes active (low level), the compensation transistor T2 conducts, and brings the drive transistor T4 into a state of diode connection. Thus, as represented by the following Equation (1), a potential Vn of the node N becomes a voltage lower than a data voltage Vdata by a threshold voltage Vth of the drive transistor T4. This potential Vn of the node N is given as a gate voltage Vg to the gate terminal of the drive transistor T4.

$$Vn = \mathrm{Vdata} + Vth \quad (1)$$

Herein, Vdata is a data voltage, and Vth is a threshold voltage of the drive transistor T4.

The first initialization transistor T1 is a transistor with a dual gate structure, which has a gate terminal connected to the previous scanning line Sj−1 and is provided between the gate terminal of the drive transistor T4 and the initialization line Vini. The transistor with the dual gate structure refers to a transistor with a structure in which a common control signal is input to gate terminals (control terminals) of two transistors, a conductive terminal of one of the transistors and a conductive terminal of the other transistor are connected to each other, and a channel layer is continuously formed of the same semiconductor layer. When a potential of the previous scanning line Sj−1 becomes active, the first initialization transistor T1 conducts, and the initialization potential Vini is given to the node N. Thus, the potential of the node N is initialized. Such operations as described above refer to initialization operations, and such a potential that initializes the potential of the node N refers to an "initialization potential." Note that the first initialization transistor T1 does not need to be the transistor with the dual gate structure.

The power supply transistor T5 has a gate terminal connected to the emission line Ej, and is provided between the high-level power supply line ELVDD and the drive transistor T4. The power supply transistor T5 supplies the high-level potential ELVDD to the first conductive terminal of the drive transistor T4 in response to the selection of the emission line Ej.

The light emission control transistor T6 has a gate terminal connected to the emission line Ej, and is provided between the drive transistor T4 and the organic EL element OLED. The light emission control transistor T6 electrically connects the second conductive terminal of the drive transistor T4 and an anode of the organic EL element PLED to each other in response to the selection of the emission line Ej. As a result, the drive current in which a current value is controlled by the drive transistor T4 flows from the high-level power supply line ELVDD through the drive transistor T4 to the organic EL element OLED.

The second initialization transistor T7 has a gate terminal (control terminal) connected to the scanning line Sj, and is provided between an anode of the organic EL element OLED and the initialization line Vini. When the scanning line Sj is selected, the second initialization transistor T7 gives the initialization potential Vini to the anode of the organic EL element OLED, and initializes a potential of the anode.

The first terminal of the storage capacitor Cst is connected to the node N, and a second terminal thereof is connected to the high-level power supply line ELVDD. The storage capacitor Cst holds a potential of the node N when the compensation transistor T2 and the first initialization transistor T1 are in the OFF state.

The organic EL element OLED has the anode (one end of the organic EL element OLED, also referred to as a "first electrode") connected to a second conductive terminal of the light emission control transistor T6, has a cathode (other end of the organic EL element OLED, also referred to as a "second electrode") connected to the low-level power supply line ELVSS, and emits light with a brightness corresponding to the current value of the drive current when the drive current to be suppled from the drive transistor T4 flows therethrough.

1.3 Normal Operation of Pixel Circuit

Figure 3:
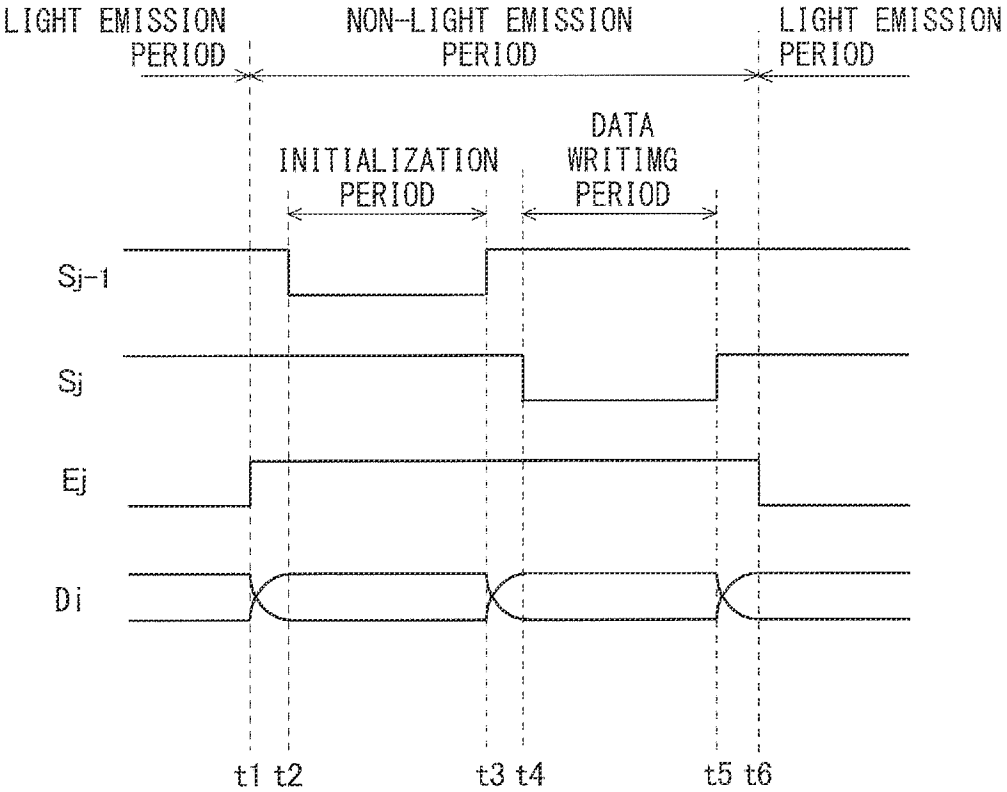
FIG. 3 is a timing chart illustrating a method of driving the pixel circuit illustrated in FIG. 2.
Figure 4:
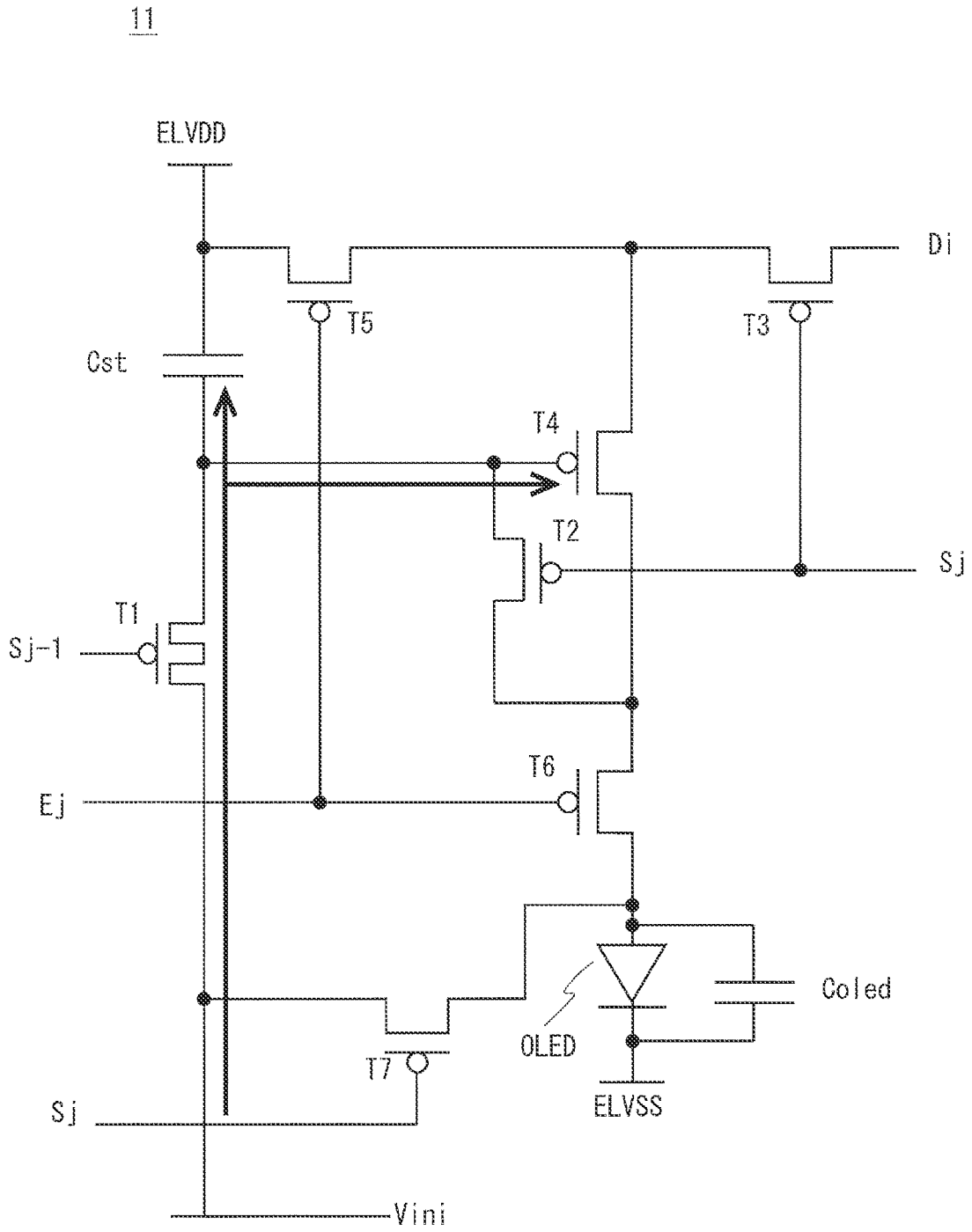
FIG. 4 is a diagram illustrating an operation of the pixel circuit in an initialization period illustrated in FIG. 3.
Figure 5:
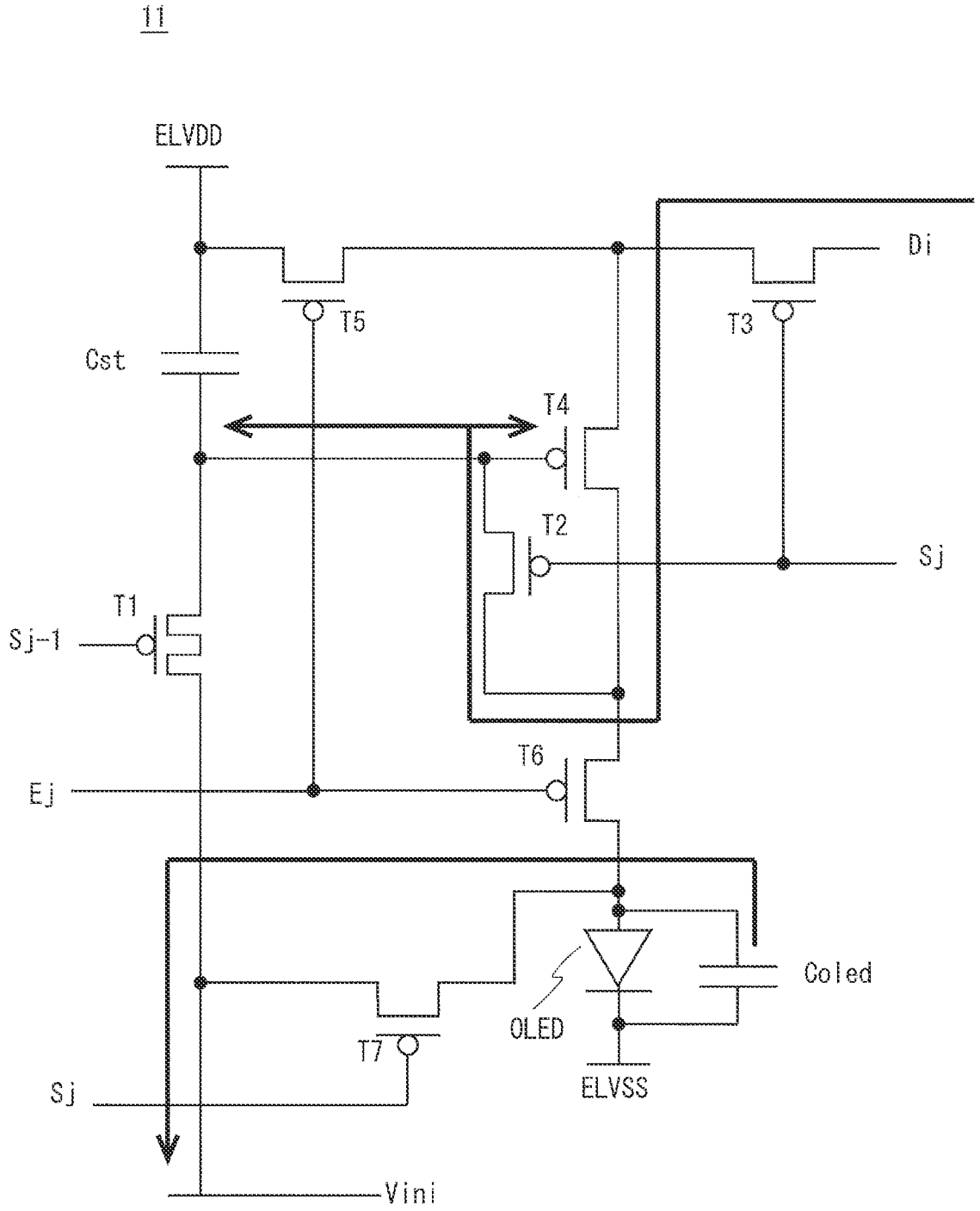
FIG. 5 is a diagram illustrating an operation of the pixel circuit in a data writing period illustrated in FIG. 3.
Figure 6:
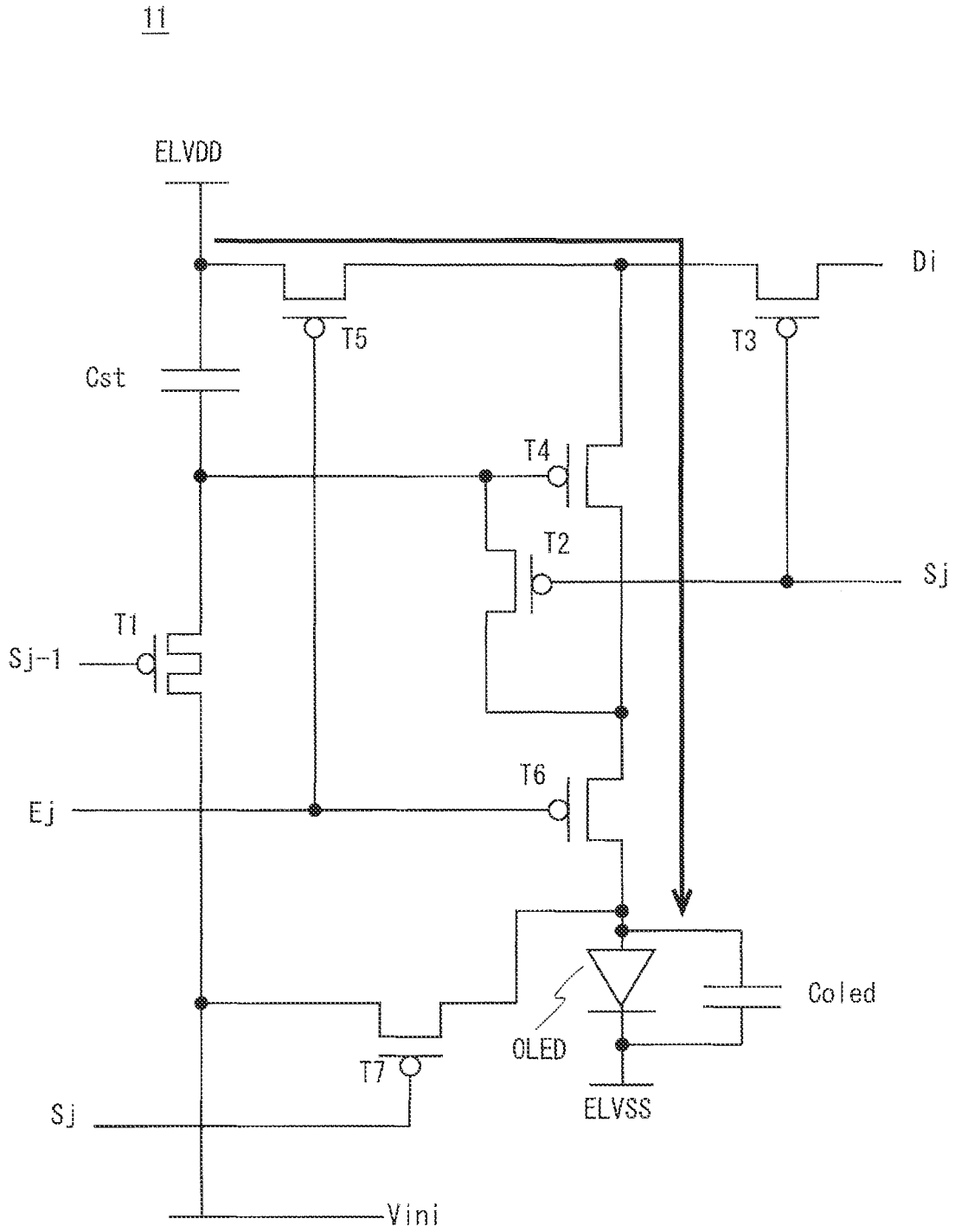
FIG. 6 is a diagram illustrating an operation of the pixel circuit in a light emission period illustrated in FIG. 3.

Next, a description will be given of a normal operation in a case in which the seven transistors included in the pixel circuit 11 are entirely normal. FIG. 3 is a timing chart illustrating a method of driving the pixel circuit 11 illustrated in FIG. 2. Moreover, FIG. 4 is a diagram illustrating an operation of the pixel circuit 11 in an initialization period illustrated in FIG. 3, FIG. 5 is a diagram illustrating an operation of the pixel circuit 11 in a data writing period illustrated in FIG. 3, and FIG. 6 illustrates an operation of the pixel circuit 11 in a light emission period illustrated in FIG. 3.

As illustrated in FIG. 3, at a time t1, a potential of the emission line Ej changes from a low level to a high level. Moreover, at a time t2, a potential of the previous scanning line Sj−1 changes from the high level to the low level. Thus, the first initialization transistor T1 turns to the ON state, and the initialization potential Vini is suppled from the initialization line Vini via the first initialization transistor T1 to the storage capacitor Cst and the node N as illustrated in FIG. 4, and the initialization potential Vini is given to the gate terminal of the drive transistor T4. Therefore, a potential of the gate terminal of the drive transistor T4 is initialized, and the potential of the node N of the pixel circuit 11 drops from a data voltage, which is charged in a previous data writing period, to the initialization potential Vini lower than the low level. Note that a low-level potential to be suppled to the previous scanning line Sj−1 at this time is the same in level as the low-level potential given to the scanning line Sj in the previous data writing period.

At a time t3, the potential of the previous scanning line Sj−1 changes from the low level to the high level, and the first initialization transistor T1 turns to the OFF state. Moreover, the data signal starts to be supplied from the data line driver 30 to the data line Di. As above, such a period from the time t2 to the time t3 is the initialization period of initializing the storage capacitor Cst and the node N.

At a time t4, the potential of the scanning line Sj changes from the high level to the low level. Moreover, a potential of the data line Di becomes a potential of the data signal. Thus, the write transistor T3 and the compensation transistor T2 turn to the ON state, and the data signal written into the node N via the write transistor T3, the drive transistor T4, and the compensation transistor T2 as illustrated in FIG. 5. Moreover, compensation for the threshold voltage of the drive transistor T4 is performed. At this time, the storage capacitor Cst is charged with a potential lower than the potential of the data signal by the threshold voltage of the drive transistor T4. The low-level potential is also given to the gate terminal of the second initialization transistor T7 connected to the scanning line Sj, and accordingly, the second initialization transistor T7 also turns to the ON state. Thus, a voltage charged to a capacitor Coled in order to cause the organic EL element OLED to emit light is discharged to the initialization line Vini via the second initialization transistor T7, and the potential of the anode of the organic EL element OLED is initialized. Note that the initialization potential Vini is set so that a potential difference between the initialization potential Vini and the low-level potential ELVSS becomes a value equal to or less than a threshold voltage of the organic EL element OLED. Therefore, the organic EL element OLED turns to a lighting-off state by the potential of the anode having been initialized.

At a time t1, the potential of the scanning line Sj changes from the low level to the high level. Thus, the write transistor T3 and the compensation transistor T2 turn to the OFF state, and the writing of the data signal into the node N is stopped. As above, a period from the time t4 to the time t5 is a data writing period of writing the data signal, which is supplied to the data line Di, into the node N.

At a time t6, the emission signal changes from the high level to the low level. Thus, the light emission control transistor T6 turns to the ON state, and the current in which the current value is controlled by the drive transistor T4 flows from the high-level power supply line ELVDD through the power supply transistor T5, the drive transistor T4 and the light emission control transistor T6 to the organic EL element OLED as illustrated in FIG. 6. Thus, the organic EL element OLED emits light with the brightness corresponding to the data signal.

1.4 Repair

If the seven transistors included in the pixel circuit 11 operate normally, then the pixel circuit 11 emits light with the brightness corresponding to the data signal. However, in some cases, at least one of the seven transistors turns to the constantly ON state or the constantly OFF state, whereby the pixel circuit 11 stops operating normally.

The pixel circuit 11 that has stopped operating normally becomes a black dot, for example, by the organic EL element OLED turning to a constantly lighting-off state or becomes a bright by the organic EL element OLED turning to a constantly lighting-on state. Moreover, in some cases, a line defect is displayed in such a manner that other pixel circuits 11 connected to the same high-level power supply line ELVDD as that of the pixel circuit 11 concerned cause an operation failure.

A display panel in which pixel circuits 11 which have stopped operating normally are constantly displayed as black dots by being repaired is not regarded as a problem in practical use since the black dots are less conspicuous if the number of such pixel circuits 11 is small. Accordingly, if a display panel that has been heretofore discarded becomes usable by being subjected to such a repair of turning the pixel circuits to black dots, then manufacturing yield of the display panel is improved. Accordingly, it becomes possible to reduce manufacturing cost.

1.5 Problem of Second Initialization Transistor

Figure 7:
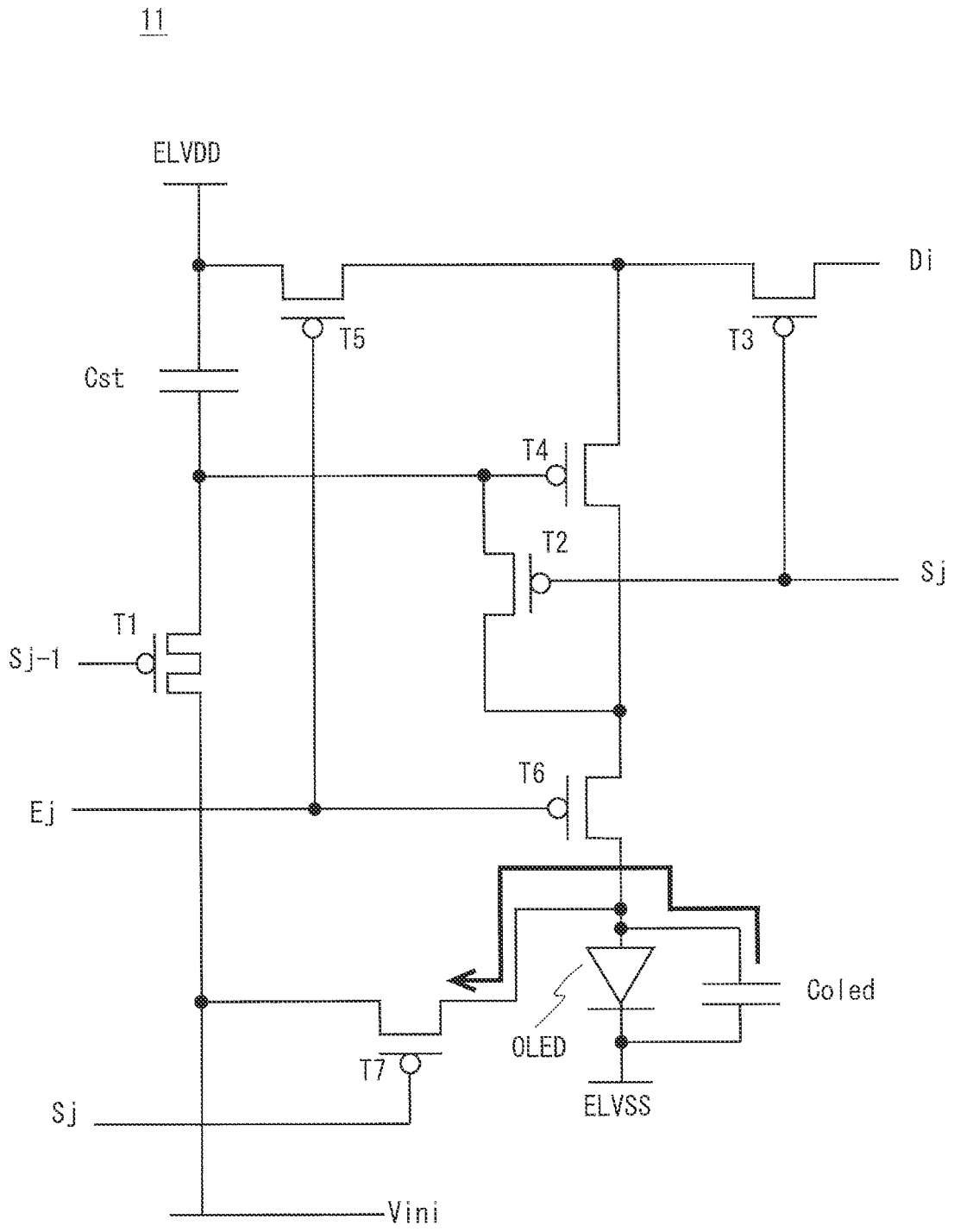
FIG. 7 is a diagram illustrating a problem when a second initialization transistor in the pixel circuit illustrated in FIG. 2 turns to a constantly OFF state.

A description will be given of the case where the second initialization transistor T7 is in the constantly OFF state. FIG. 7 is a diagram illustrating an operation of the pixel circuit 11 when the second initialization transistor T7 is in the constantly OFF state. As illustrated in FIG. 7, in a case in which the second initialization transistor T7 is in the constantly OFF state, even if the low-level scanning signal is given to the gate terminal of the second initialization transistor T7 in the data writing period, the potential of the anode of the organic EL element OLED is not initialized since the second initialization transistor T7 is in the constantly OFF state. Therefore, when the drive current corresponding to the data signal is supplied to the organic EL element OLED in the light emission period, the organic EL element OLED emits light with a brightness (abnormal tone) different from the brightness corresponding to the data signal concerned.

Figure 8:
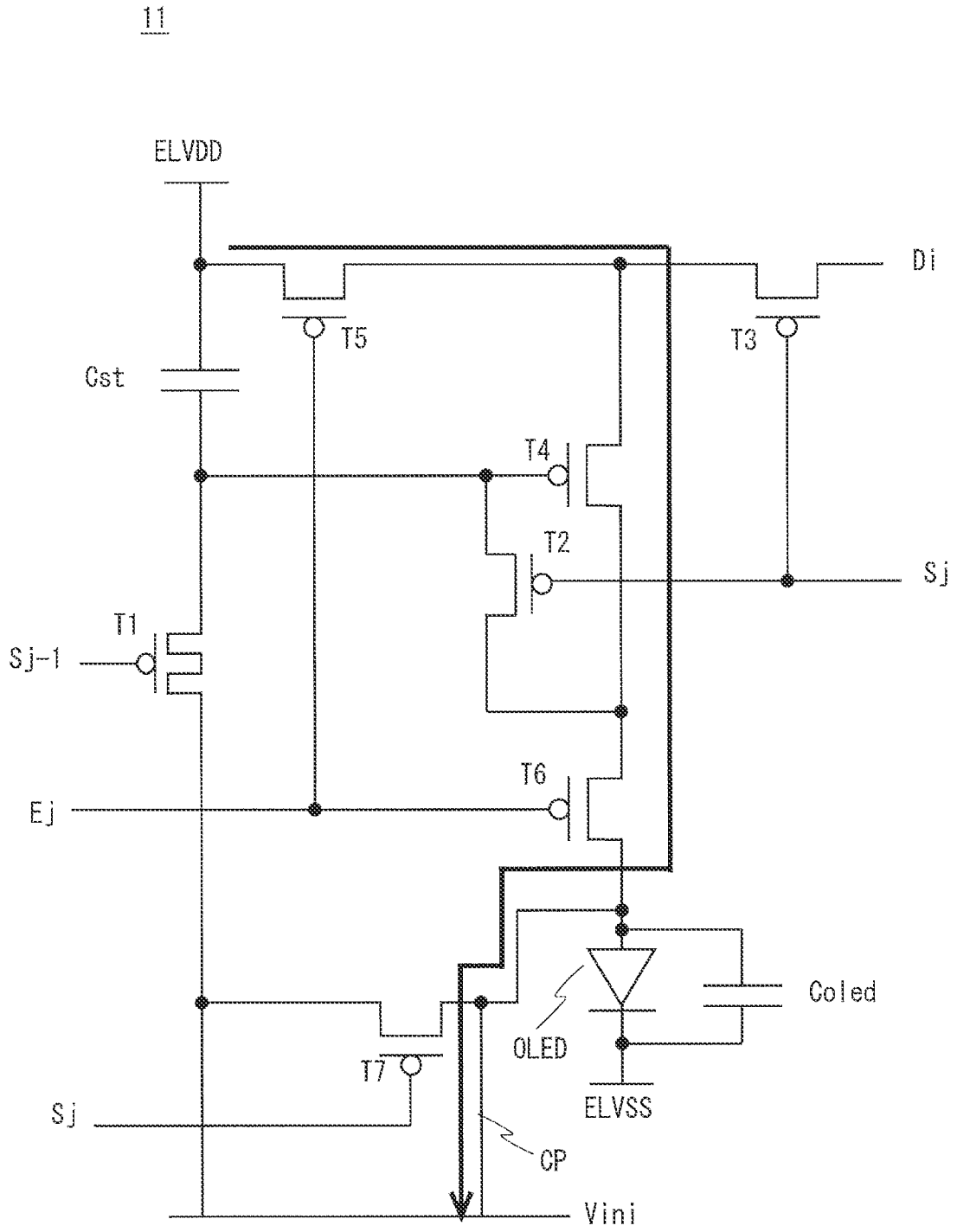
FIG. 8 is a diagram illustrating a repair to be performed when the second initialization transistor is in the constantly OFF state.

A description will be given of a repair to be performed when the second initialization transistor T7 turns to the constantly OFF state. FIG. 8 is a diagram illustrating the repair to be performed when the second initialization transistor T7 turns to the constantly OFF state. As illustrated in FIG. 8, a semiconductor layer SI that serves as a first conductive terminal of the second initialization transistor T7 and the initialization line Vini are electrically connected to each other. Thus, the initialization potential Vini is applied to the anode of the organic EL element OLED, and accordingly, the voltage to be applied to the organic EL element OLED becomes equal to or less than the threshold voltage. Therefore, the organic EL element OLED is in the constantly lighting-off state, and the pixel circuit 11 is constantly kept black. In this case, the drive current that has passed through the light emission control transistor T6 does not flow to the organic EL element OLED, but flows to the initialization line Vini through a connection portion CP at which the first conductive terminal of the second initialization transistor T7 and the initialization line Vini are directly connected to each other.

Figure 9:
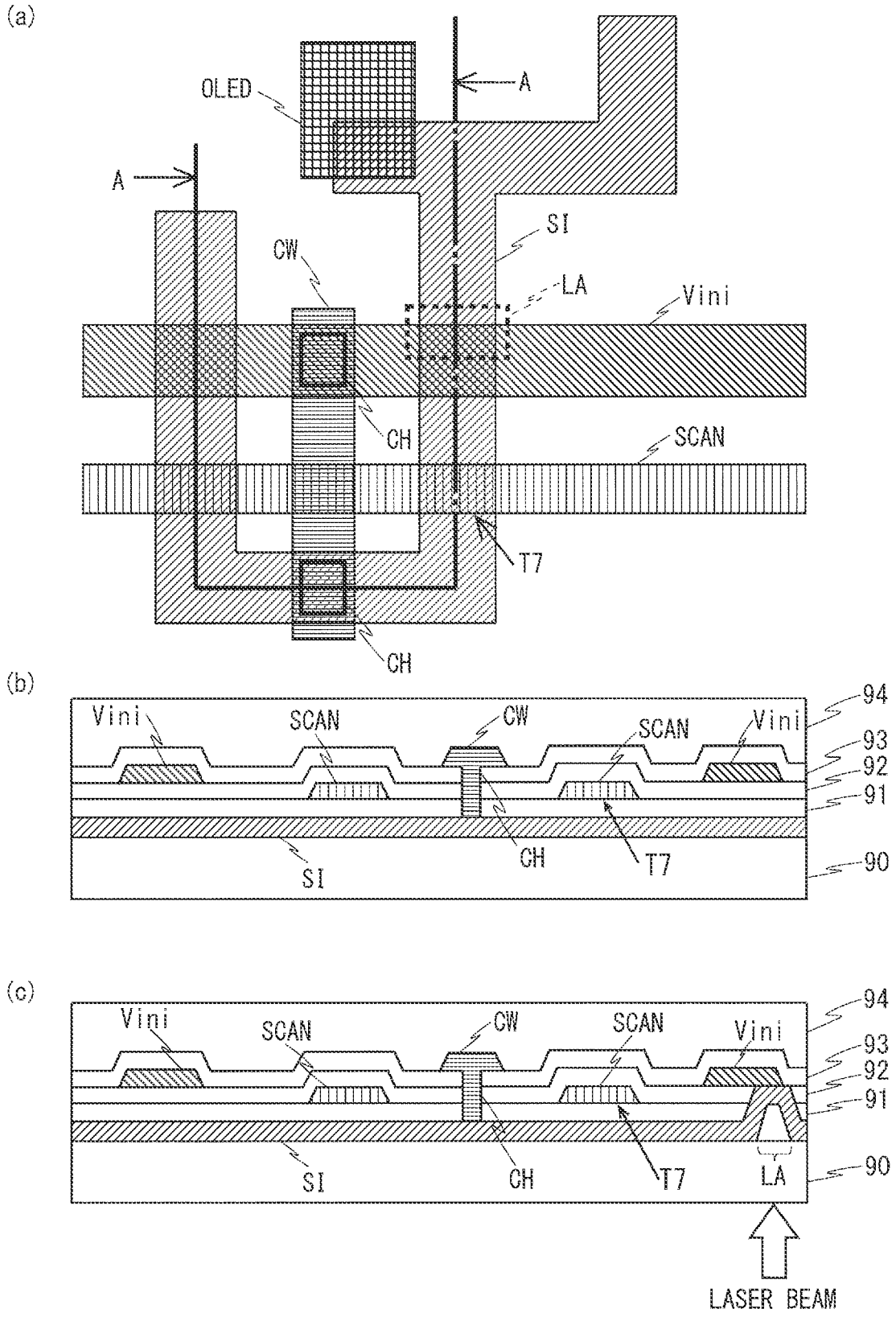
FIG. 9 is a diagram illustrating a part of a wiring layout of the pixel circuit included in the display device according to the first embodiment: more specifically, (a) is a plan view of a part of the wiring layout of the pixel circuit; (b) is a cross-sectional view of the pixel circuit before repair, taken along an arrow line A-A illustrated in (a); and (c) is a cross-sectional view of the pixel circuit after repair, taken along the arrow line A-A illustrated in (a).

Next, a description will be given of a repair method for correcting the abnormal tone when the second initialization transistor T7 is in the constantly OFF state. FIG. 9 is diagrams illustrating a part of a wiring layout of the pixel circuit 11 included in the display device according to the present embodiment: more specifically, FIG. 9(*a*) is a plan view of a part of the wiring layout of the pixel circuit 11; FIG. 9(*b*) is a cross-sectional view of the pixel circuit 11 before repair, taken along an arrow line A-A illustrated in FIG. 9(*a*); and FIG. 9(*c*) is a cross-sectional view of the pixel circuit 11 after repair, taken along the arrow line A-A illustrated in FIG. 9(*a*).

The semiconductor layer SI formed on an insulating substrate 90 functions as source/drain regions and channel regions of transistors, and functions as wiring regions for connecting to other transistors. Accordingly, in the semiconductor layer SI formed on the pixel circuit 11 composed of the p channel-type transistors, except for regions which serve as the channel regions of the transistors, not only the source/drain regions of the transistors but also the wiring regions are doped with p-type impurities in order to reduce resistance values thereof.

As illustrated in FIGS. 9(*a*) and 9(*b*), the semiconductor layer SI made of a silicon film is formed on the insulating substrate 90 that transmits a laser beam. So as to cover the semiconductor layer SI, a gate insulating film 91 made of an inorganic insulating film, for example, such as a silicon oxide film and a silicon nitride film is formed. On the gate insulating film 91, a scanning line SCAN that functions as the gate terminal (control terminal) of the second initialization transistor T7 is formed in a direction of intersecting the semiconductor layer SI. The scanning line SCAN is made of a first display wiring layer that is a metal film.

So as to cover the scanning line SCAN, a first interlayer insulating film (also referred to as "first inorganic insulating film") 92 made of an inorganic insulating film is formed. On the first interlayer insulating film 92, the initialization line Vini made of a second display wiring layer that is a metal film is formed. In a region opposite to the scanning line SCAN, the initialization line Vini extends in parallel to the scanning line SCAN. So as to cover the initialization line Vini, a second interlayer insulating film (also referred to as a "second inorganic insulating film") 93 made of an inorganic insulating film is formed.

On the second interlayer insulating film 93 made of the inorganic insulating film formed so as to cover the initialization line Vini, a connection wire CW is formed of a third display wiring layer that is a metal film. The connection wire CW is connected individually to the initialization line Vini and the semiconductor layer SI via a contact hole CH. Thus, a second conductive terminal of the second initialization transistor T7 and the initialization line Vini are electrically connected to each other via the connection wire CW. Moreover, a planarizing film 94 made of an inorganic insulating film is formed so as to cover the connection wire CW.

As illustrated in FIG. 9(*c*), in order to connect the semiconductor layer SI to the initialization line Vini, a laser irradiation area LA of the semiconductor layer SI is irradiated with a laser beam from a back side of the insulating substrate 90. At this time, the semiconductor layer SI disappears if an output of the laser beam is too large, and the semiconductor layer SI cannot be connected to the initialization line Vini if the output of the laser beam is too small. Accordingly, the laser irradiation area LA of the semiconductor layer SI is irradiated with a laser beam with an output set so that the gate insulating film 91 and the first interlayer insulating film 92, which are formed between the semiconductor layer SI and the initialization line Vini, evaporate, and that the semiconductor layer SI is surely connected to the initialization line Vini. Thus, the gate insulating film 91 and the first interlayer insulating film 92, which are sandwiched between the semiconductor layer SI and the initialization line Vini, disappear by evaporation, and the laser irradiation area LA of the semiconductor layer SI is connected to the initialization line Vini (this matter is sometimes referred to as "laser melt" or "melt").

The semiconductor layer SI is doped with p-type impurities, and accordingly, the semiconductor layer SI is brought into ohmic contact with the initialization line Vini in the laser irradiation area LA. Thus, the initialization potential Vini is applied to the anode of the organic EL element OLED, and accordingly, the voltage to be applied to the organic EL element OLED becomes equal to or less than the threshold voltage. As a result, even if the second initialization transistor T7 causes an operation failure, the organic EL element OLED is in the constantly lighting-off state, and the pixel circuit 11 is constantly kept black.

Note that, when the first display wiring layer that constitutes the initialization line Vini is completely broken by being irradiated with the laser beam, the initialization potential Vini stops being supplied to other pixel circuits connected to the initialization line Vini. As a result, the other pixel circuits connected to the initialization line Vini cause an operation failure and a line defect occurs. Accord the initialization line Vini is prevented from being completely broken even if an irradiation position of the laser beam deviates a little from a target. For example, it is preferable that the laser irradiation area LA be set so that at least approximately a half of a line width of the initialization line Vini remains after the irradiation of the laser beam. Moreover, though the laser irradiation area LA is provided at the organic EL element OLED side in FIG. 9(*c*), the laser irradiation area LA may be provided at the scanning line SCAN side.

1.6 Effect

According to the present embodiment, the laser irradiation area LA of the semiconductor layer SI is irradiated with the laser beam from the back side of the insulating substrate 90. Thus, the initialization potential Vini is applied to the anode of the organic EL element OLED, and accordingly, the voltage to be applied to the organic EL element OLED becomes equal to or less than the threshold voltage. Therefore, the organic EL element OLED is in the constantly lighting-off state, and the pixel circuit 11 is constantly kept black. At this time, the drive current that has passed through the light emission control transistor T6 flows to the initialization line Vini through the connection portion CP. Moreover, according to a manufacturing method of the present embodiment, at least a part of the region where the initialization line Vini is superimposed on the semiconductor layer SI is irradiated with the laser beam, whereby the repair can be performed without fusing the initialization line Vini by the laser beam.

1.7 Modification Example

Figure 10:
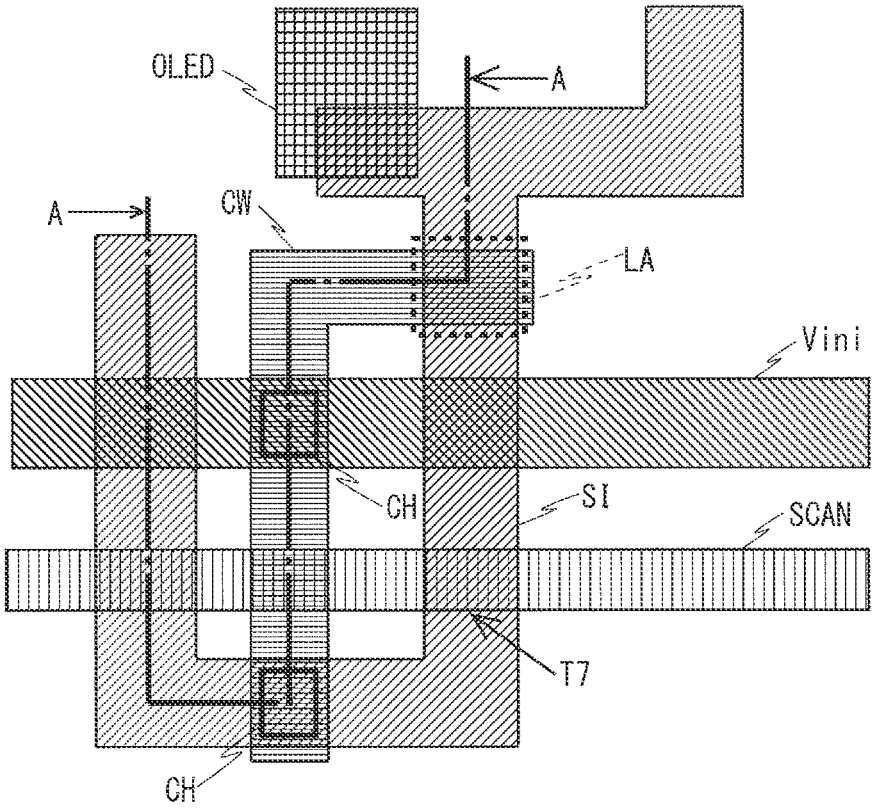
FIG. 10 is a diagram illustrating a part of a wiring layout of a pixel circuit included in a display device according to a modification example of the first embodiment: more specifically, (a) is a plan view of a part of the wiring layout of the pixel circuit; (b) is a cross-sectional view of the pixel circuit before repair, taken along an arrow line B-B illustrated in (a); and (c) is a cross-sectional view of the pixel circuit after repair, taken along the arrow line B-B illustrated in (a).
Figure 10:
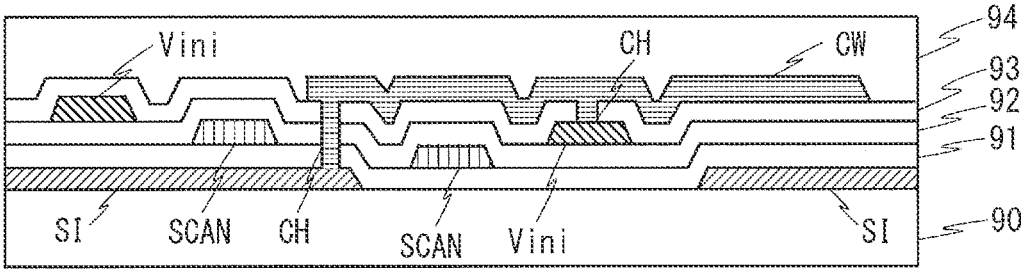
Figure 10:
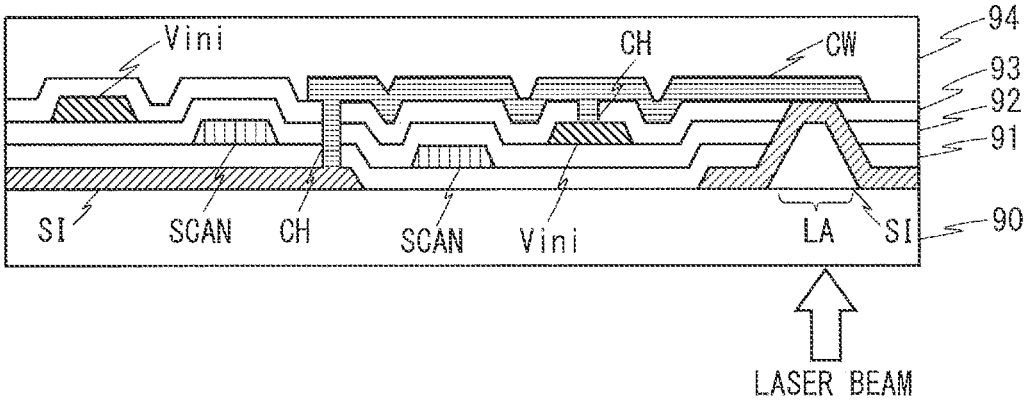

Next, a description will be given of another repair method for correcting the operation failure (abnormal tone) when the second initialization transistor T7 is in the constantly OFF state. FIG. 10 is diagrams illustrating a part of a wiring layout of a pixel circuit 11 included in a display device according to a modification example of the present embodiment: more specifically, FIG. 10(*a*) is a plan view of a part of the wiring layout of the pixel circuit 11; FIG. 10(*b*) is a cross-sectional view of the pixel circuit 11 before repair, taken along an arrow line B-B illustrated in FIG. 10(*a*); and FIG. 10(*c*) is a cross-sectional view of the pixel circuit 11 after repair, taken along the arrow line B-B illustrated in FIG. 10(*a*).

As illustrated in FIGS. 10(*a*) and 10(*b*), arrangement of the semiconductor layer SI, the scanning line SCAN and the initialization line Vini before repair is the same as the arrangement illustrated in FIGS. 9(*a*) and 9(*b*), and accordingly, a description of these will be omitted. Moreover, in the present modification example, in order that the connection wire CW described in the first embodiment can also be used as a wire for the repair, an end of the connection wire CW on the initialization line Vini side further extends and intersects the semiconductor layer SI on an opposite side to the scanning line SCAN while sandwiching the initialization line Vini therebetween. Therefore, the connection wire CW is formed so as to be superimposed on the semiconductor layer SI while sandwiching the gate insulating film 91, the first interlayer insulating film 92 and the second interlayer insulating film 93 therebetween. Moreover, like the connection wire CW of the first embodiment, the connection wire CW of the present modification example is also formed of the third display wiring layer, which is a metal layer, on the second interlayer insulating film 93, and is electrically connected by the contact hole CH to the initialization line Vini and the semiconductor layer SI that serves as the second conductive terminal of the second initialization transistor T7.

In this case, the repair is performed by irradiating the laser irradiation area LA of the semiconductor layer SI, on which the connection wire M is superimposed, with the laser beam from the back side of the insulating substrate 90. Thus, the gate insulating film 91, the first interlayer insulating film 92 and the second interlayer insulating film 93, which are sandwiched between the semiconductor layer SI and the connection wire CW, disappear by evaporation, and the laser irradiation area LA of the semiconductor layer SI is connected to the connection wire CW. As a result, the initialization potential Vini is applied to the anode of the organic EL element OLED, and accordingly, the voltage to be applied to the organic EL element OLED becomes equal to or less than the threshold voltage. As a result, even if the second initialization transistor T7 causes an operation failure, the organic EL element OLED is in the constantly lighting-off state, and the pixel circuit 11 is constantly kept black. At this time, even if the second initialization transistor T7 is in the constantly OFF state, the drive current that has passed through the light emission control transistor T6 flows to the initialization line Vini via the connection wire CW that connects the semiconductor layer SI and the initialization line Vini to each other. In this case, in the circuit diagram illustrated in FIG. 8, in the connection wire CW, a region from the laser-molten region (the first conductive terminal of the second initialization transistor T7) of the semiconductor layer SI to the initialization line Vini corresponds to the connection portion CP. Moreover, the whole of the region where the connection wire CW connected to the initialization line Vini is superimposed on the semiconductor layer SI can be irradiated with the laser beam, and accordingly, the repair to connect the initialization line Vini to the semiconductor layer SI can be surely performed.

2. Second Embodiment

In the first embodiment, the drive current that flows from the high-level power supply line ELVDD through the power supply transistor T5, the drive transistor T4, and the light emission control transistor T6 is not supplied to the organic EL element OLED, but is caused to flow to the initialization line Vini through the connection portion CP of the first conductive terminal of the second initialization transistor T7 and the initialization line Vini. In this case, the pixel circuit 11 can be constantly kept black; however, since ON resistances of these transistors T5, T4 and T6 are small, a current value thereof is increased. Therefore, there has been a problem that power consumption of the pixel circuit 11 is increased. In consideration of the above, in the present embodiment, a description will be given of a repair method capable of not only turning the pixel circuit 11 into the black dot but also reducing the power consumption of the pixel circuit 11 turned into the black dot. Note that, since a configuration of the display device, a configuration of the pixel circuit 11 and an operation of the pixel circuit 11 in the present embodiment are individually the same as those in the case described in the first embodiment, a description thereof will be omitted.

2.1. Operation of Pixel Circuit

Figure 11:
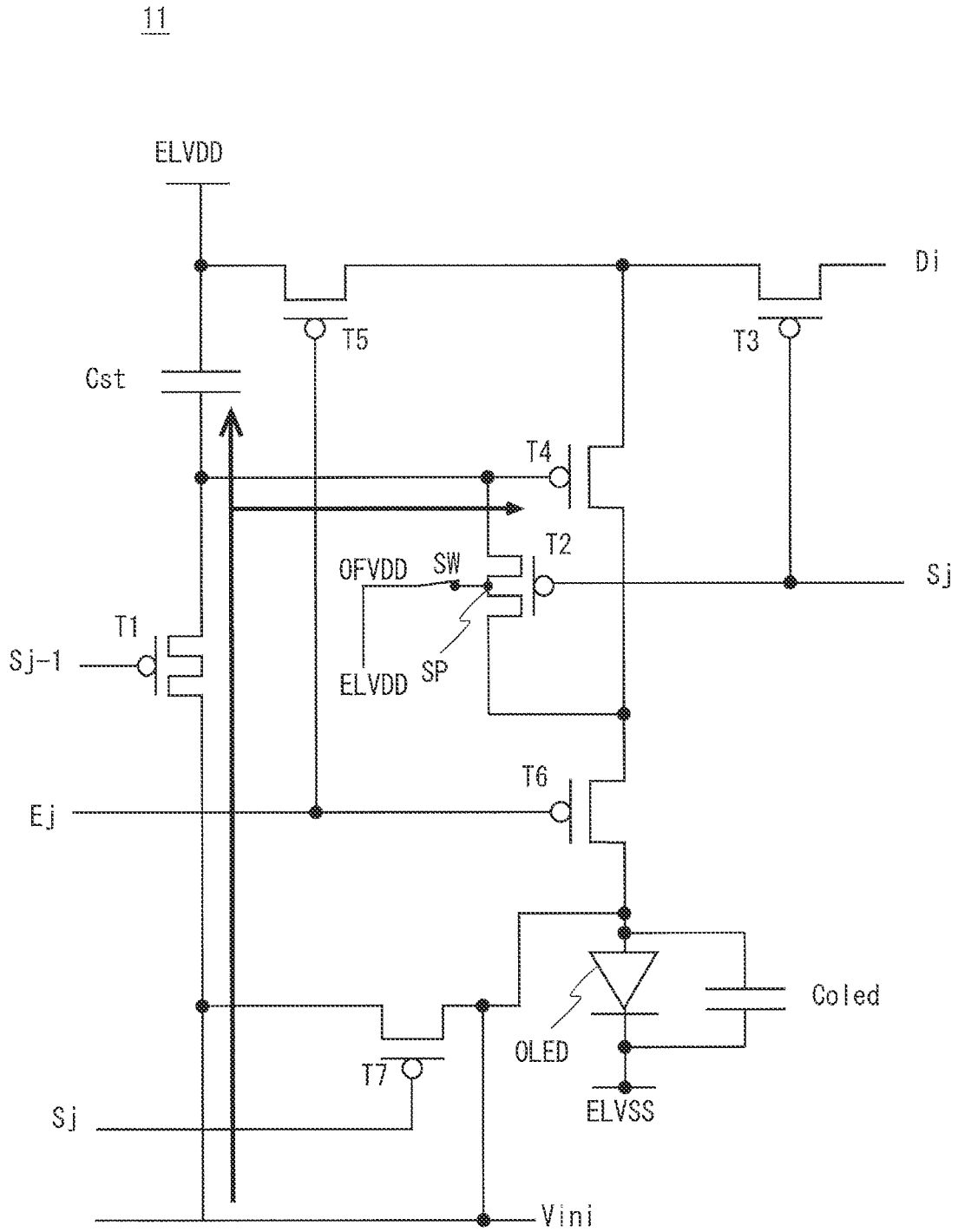
FIG. 11 is a diagram for explaining that, in a pixel circuit included in a display device according to a second embodiment, a pixel circuit is turned to a black state and power consumption is reduced by a repair to improve an operation failure of a second initialization transistor.
Figure 12:
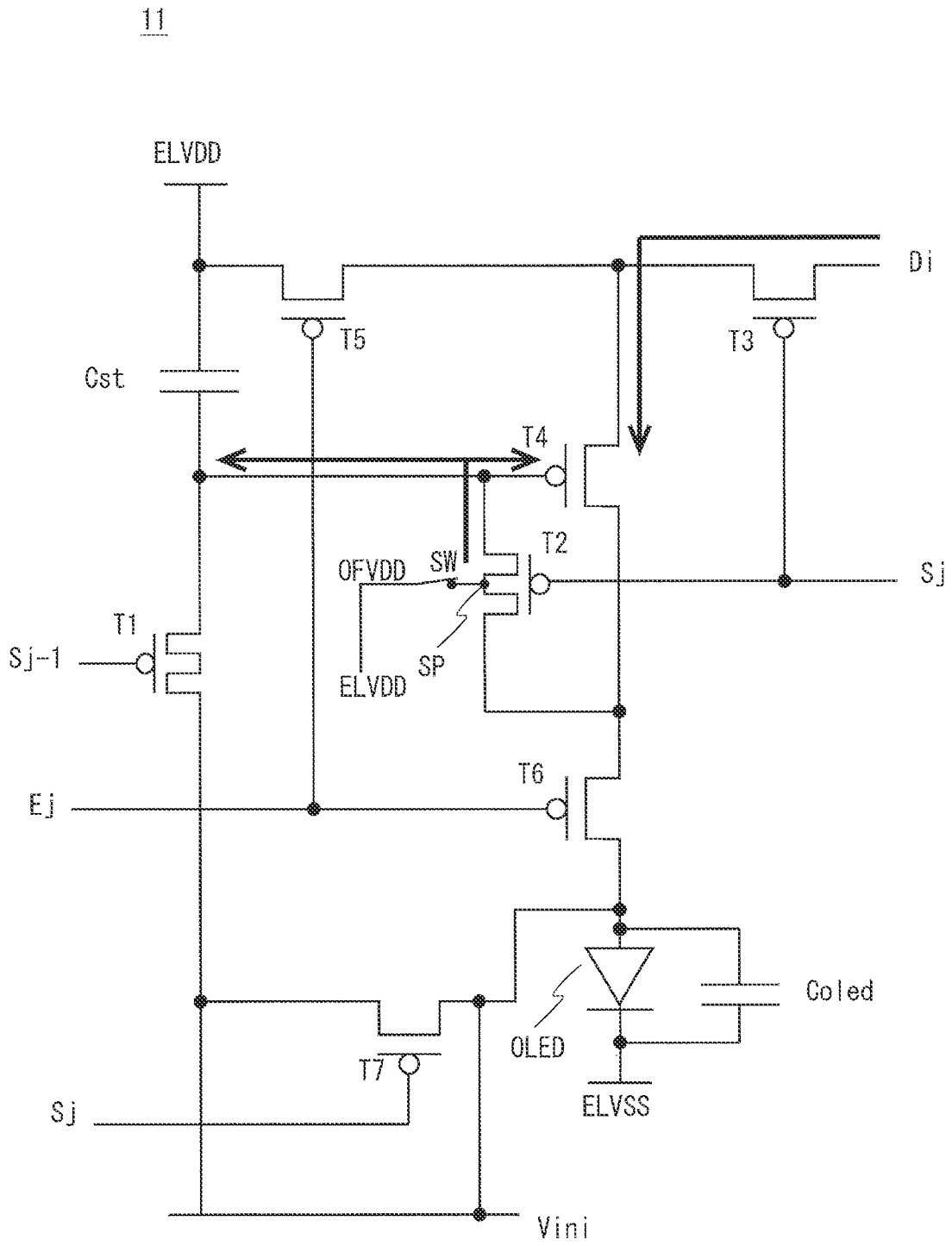
FIG. 12 is a diagram for explaining that, in the pixel circuit included in the display device according to the second embodiment, the pixel circuit is turned to the black state and the power consumption is reduced by the repair to improve the operation failure of the second initialization transistor.
Figure 13:
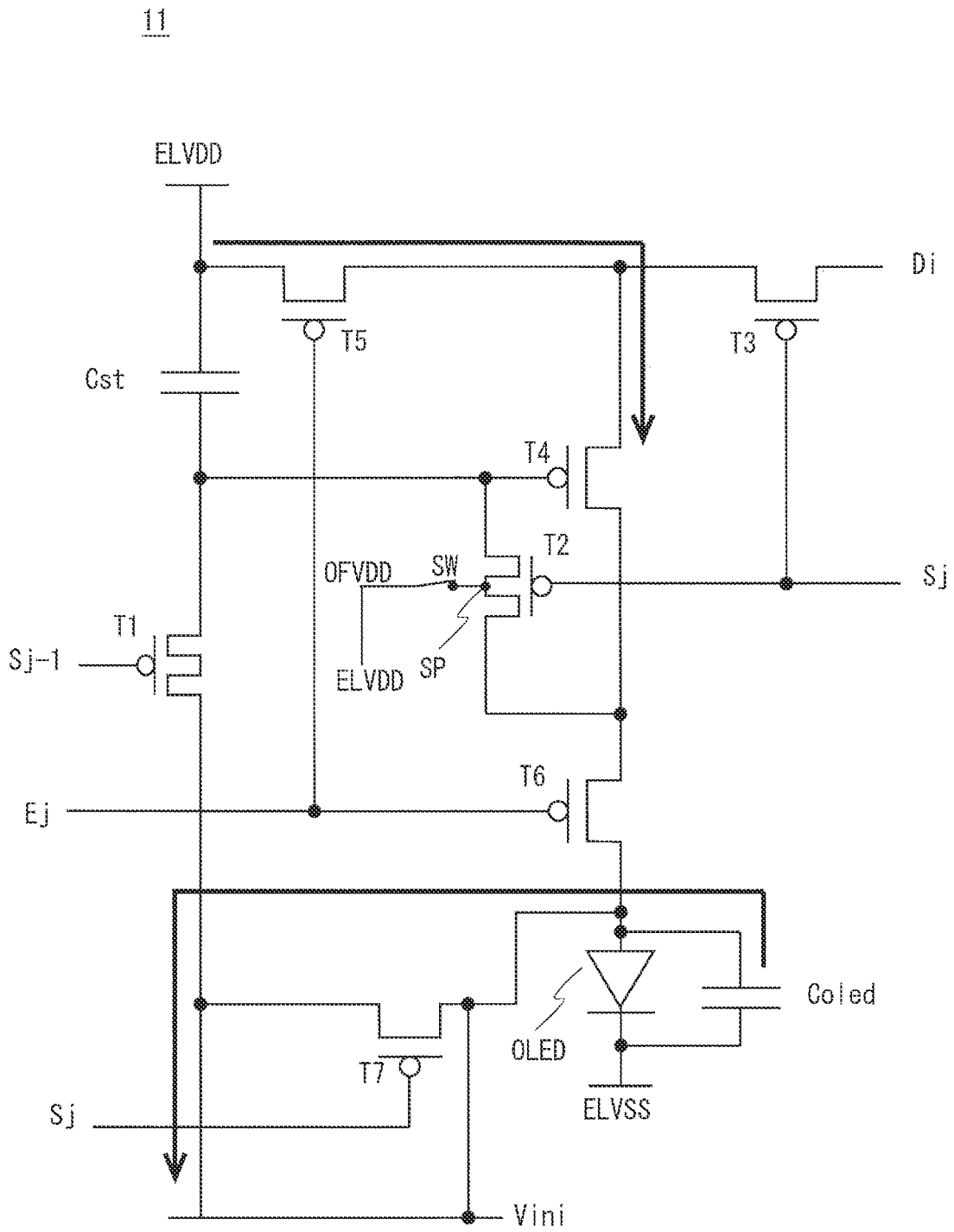
FIG. 13 is a diagram for explaining that, in the pixel circuit included in the display device according to the second embodiment, the pixel circuit is turned to the black state and the power consumption is reduced by the repair to improve the operation failure of the second initialization transistor.

FIGS. 11 to 13 are diagrams for explaining that, by the repair to correct the operation failure of the second initialization transistor T7 in the pixel circuit 11 included in the display device according to the present embodiment, not only the pixel circuit 11 is kept black, but also the power consumption can be reduced. As illustrated in FIG. 11, the compensation transistor T2 is a transistor with a dual gate structure in order to reduce a leakage current. In order to distinguish two transistors which constitute the dual gate structure, a transistor that has a first conductive terminal connected to the second conductive terminal of the drive transistor T4 is called a first compensation transistor T21, and a transistor that has a second conductive terminal connected to the node N is called a second compensation transistor T22. An electrode given the high-level potential ELVDD is disposed above a connection point SP at which the second conductive terminal of the first compensation transistor T21 and the first conductive terminal of the second compensation transistor T22 are connected to each other.

The laser beam is applied to the laser irradiation area LA set on the semiconductor layer SI that constitutes the connection point SP sandwiched between a second conductive terminal of the first compensation transistor T21 and a first conductive terminal of the second compensation transistor T22. Thus, the insulating film sandwiched between the laser irradiation area LA of the semiconductor layer SI and the electrode given the high-level potential ELVDD evaporates, and the laser irradiation area LA of the semiconductor layer SI is connected to the electrode. As a result, from the high-level power supply line ELVDD, the high-level potential ELVDD is given to the connection point SP of the second conductive terminal of the first compensation transistor T21 and the first conductive terminal of the second compensation transistor T22. Note that, in the circuit diagrams of the pixel circuit 11, which are illustrated in FIGS. 11 to 13, the fact that the laser irradiation area LA of the semiconductor layer SI is molten by the laser melt and connected to the high-level potential ELVDD is represented as a state where a switch SW is turned on for the sake of convenience.

When the potential of the previous scanning line Sj−1 changes from the high level to the low level, the first initialization transistor T1 turns to the ON state, and the initialization potential Vini is applied to the first terminal of the storage capacitor Cst and the gate terminal of the drive transistor T4. Thus, the potentials of the storage capacitor Cst and the gate terminal of the drive transistor T4 are initialized.

Next, when the potential of the scanning line Sj changes from the high level to the low level, the first and second compensation transistors T21 and T22 turn to the ON state. Thus, as illustrated in FIG. 12, the high-level potential ELVDD given to the connection point SP of the first compensation transistor T21 and the second compensation transistor T22 is given to the gate terminal of the drive transistor T4 via the node N. Therefore, the drive transistor T4 turns to the OFF state.

Thereafter, when the potential of the emission line Ej changes from the high level to the low level, the power supply transistor T5 and the light emission control transistor T6 turn to the ON state. At this time, the drive transistor T4 is in the OFF state, the drive current does not flow to the organic EL element OLED as illustrated in FIG. 13. Therefore, the organic EL element OLED is in the constantly lighting-off state, and the pixel circuit 11 is constantly kept black. Moreover, a current does not flow to the pixel circuit 11 when the organic EL element OLED is in the lighting-off state, and accordingly, the power consumption of the pixel circuit 11 is reduced.

Note that the high-level potential ELVDD to be given to the connection point SP of the first compensation transistor T21 and the second compensation transistor T22 is referred to as an "off-state voltage." Moreover, the high-level power supply line ELVDD that gives the OFF voltage to the connection point SP of the first compensation transistor T21 and the second compensation transistor T22 is referred to as an off-state voltage supply line OFVDD in some cases.

2.2 Wiring Layout

Figure 14:
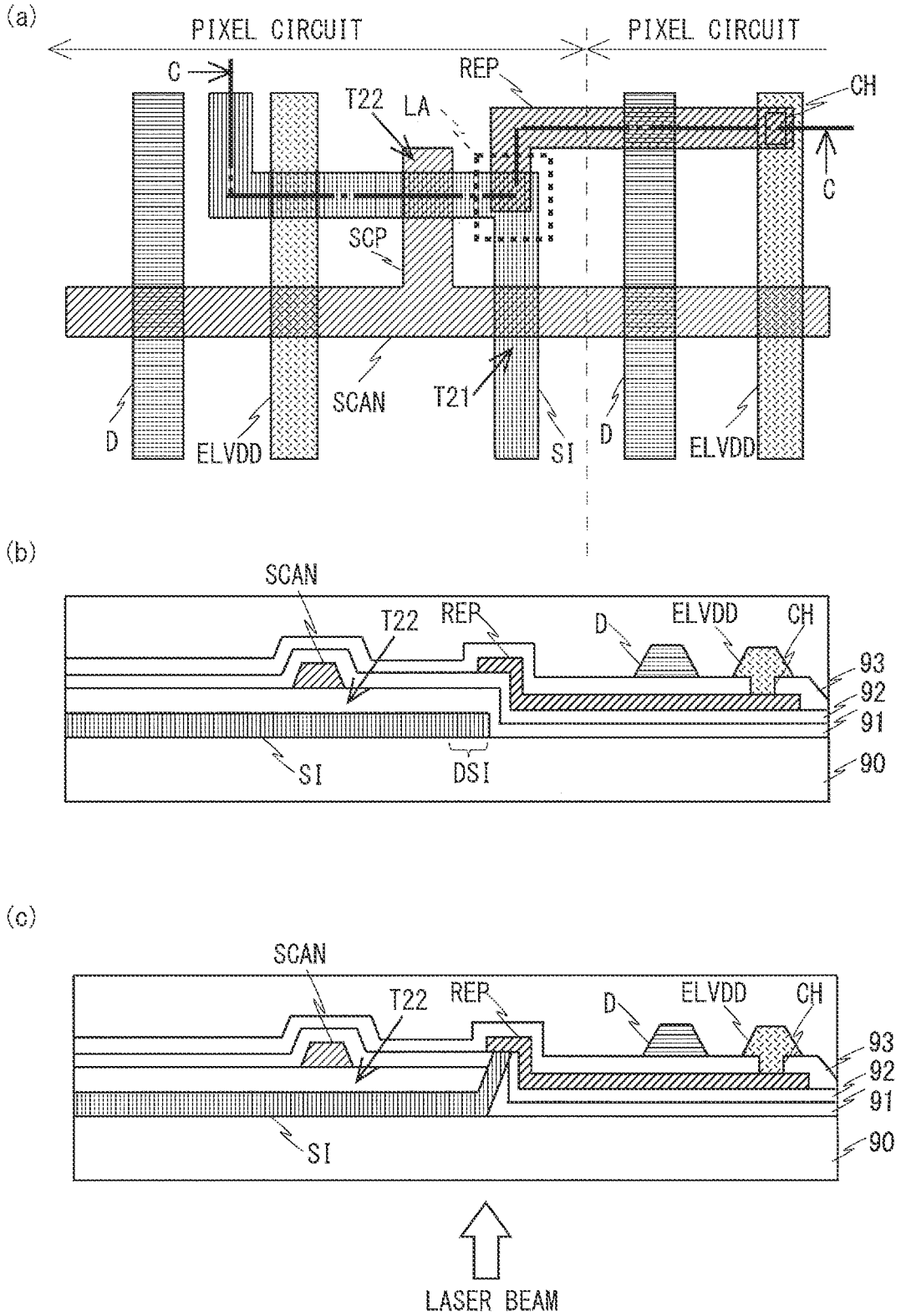
FIG. 14 is a diagram illustrating a part of a wiring layout of the pixel circuit included in the display device according to the second embodiment: more specifically, (a) is a plan view of a part of the wiring layout of the pixel circuit; (b) is a cross-sectional view of the pixel circuit before repair, taken along an arrow line C-C illustrated in (a); and (c) is a cross-sectional view of the pixel circuit after repair, taken along the arrow line C-C illustrated in (a).

A description will be given of a repair method for turning the pixel circuit into the black dot and reducing the power consumption thereof. FIG. 14 is a diagram illustrating a part of a wiring layout or the pixel circuit included in the display device according to the present embodiment: more specifically, FIG. 14(*a*) is a plan view of a part of the wiring layout of the pixel circuit; FIG. 14(*b*) is a cross-sectional view of the pixel circuit before repair, taken along an arrow line C-C illustrated in FIG. 14(*a*); and FIG. 14(*c*) is a cross-sectional view of the pixel circuit after repair, taken along the arrow line C-C illustrated in FIG. 14(*a*).

As illustrated in FIG. 14(*a*), the high-level power supply line ELVDD and the data line D in the pixel circuit and a high-level power supply line ELVDD and a data line D in a pixel circuit adjacent to the pixel circuit concerned are arranged in parallel to each other, and the scanning line SCAN is disposed so as to intersect with them. The scanning line SCAN has a protrusion SCP branched in a region sandwiched between the high-level power supply line ELVDD and a repair wire REP for use in a repair to be described later. The protrusion SCP extends in parallel to the high-level power supply line ELVDD.

The semiconductor layer SI is formed so as to intersect the protrusion SCP of the scanning line SCAN once and the scanning line SCAN once. The first compensation transistor T21 is formed at a position where the scanning line SCAN intersects the semiconductor layer SI, and the second compensation transistor T22 is formed at a position where the protrusion SCP of the scanning line SCAN intersects the semiconductor layer SI. Moreover, one end of the repair wire REP for use at the time of repair is formed so as to be superimposed on the semiconductor layer SI. The other end of the repair wire REP is connected to the high-level power supply line ELVDD of the adjacent pixel circuit via the contact hole CH.

Next, a repair method will be described. As illustrated in FIG. 14(*b*), the laser irradiation area LA2 of the semiconductor layer SI, which is sandwiched by the first compensation transistor T21 and the second compensation transistor T22, and the one end of the repair wire REP are separated from each other by the gate insulating film 91 and the first interlayer insulating film 92.

As illustrated in FIG. 14(*c*), from the back side of the insulating substrate 90, a laser irradiation area LA2 of the semiconductor layer SI is irradiated with a laser beam set so as to evaporate the gate insulating film 91 and the first interlayer insulating film 92, which are provided between the laser irradiation area LA2 of the semiconductor layer SI and the repair wire REP, to melt the semiconductor layer SI of the laser irradiation area LA2, and to surely connect the semiconductor layer SI to the high-level power supply line ELVDD. Thus, the laser irradiation area LA2 of the semiconductor layer SI is electrically connected to the high-level power supply line ELVDD, and the high-level potential ELVDD is given to the gate terminal of the drive transistor T4. As a result, the drive transistor T4 turns to the OFF state, the pixel circuit is constantly kept black, and the power consumption thereof is further reduced.

2.3 Effect

According to the present embodiment, even if the power supply transistor T5 and the light emission control transistor T6 turn to the ON state, the drive transistor T4 is in the OFF state. Thus, since no currents flow to the organic EL element OLED, not only the pixel circuit 11 is kept black, but also the power consumption of the pixel circuit 11 can be reduced. Note that, as described in the first embodiment, in some cases, the pixel circuit 11 can be constantly kept black by forming the connection portion CP of the first conductive terminal of the second initialization transistor T7 and the initialization line Vini. However, the repair to be performed by the irradiation of the laser beam sometimes fails. Therefore, in order to more surely turn the pixel circuit 11 to the constantly black dot, it is preferable that the repair as described in the first embodiment be combined with the repair described in the present embodiment.

2.4 First Modification Example

Figure 15:
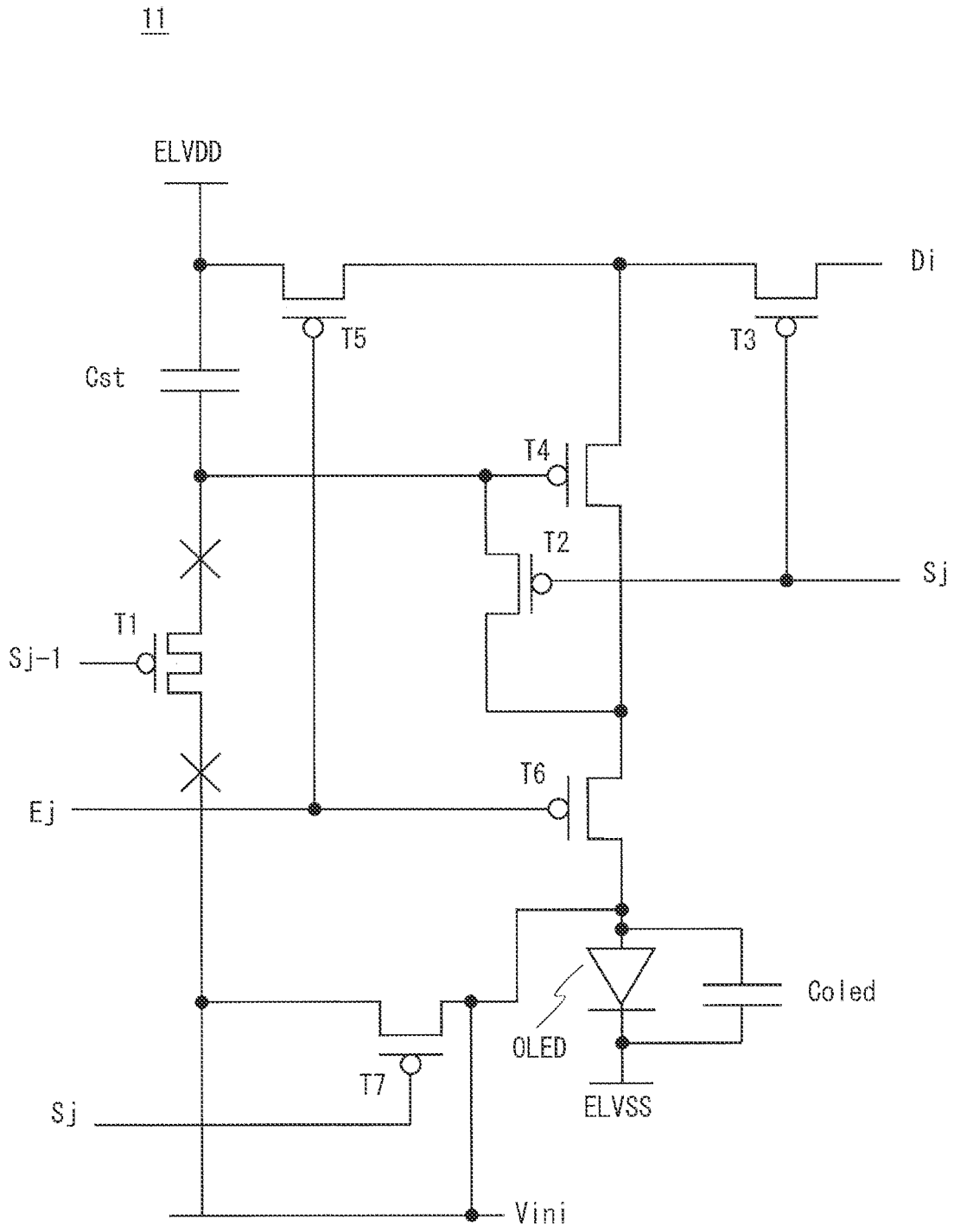
FIG. 15 is circuit diagram of pixel circuit according to a first modification example of the second embodiment.

FIG. 15 is a circuit diagram of a pixel circuit 11 after repair according to a first modification example of the present embodiment. As illustrated in FIG. 15, at least either between the first conductive terminal of the first initialization transistor T1 and the node N or between the second conductive terminal of the first initialization transistor T1 and the initialization line Vini, a wire of a semiconductor layer formed of a silicon film is fused at a spot added with "×" in FIG. 15. The fusing of the wire is performed by irradiating the wire, which is made of the semiconductor layer formed on an insulating substrate, with a laser beam from a back side of the insulating substrate to evaporate the semiconductor layer.

By fusing the wire, the initialization potential Vini stops being given to the node N, and accordingly, the drive transistor T4 stops being subjected to a diode connection. As a result, a large current stops flowing to the drive transistor T4. Thus, it becomes not only possible to turn the pixel circuit 11 into the black dot, but it also becomes possible to further reduce the power consumption thereof.

2.5 Second Modification Example

Figure 16:
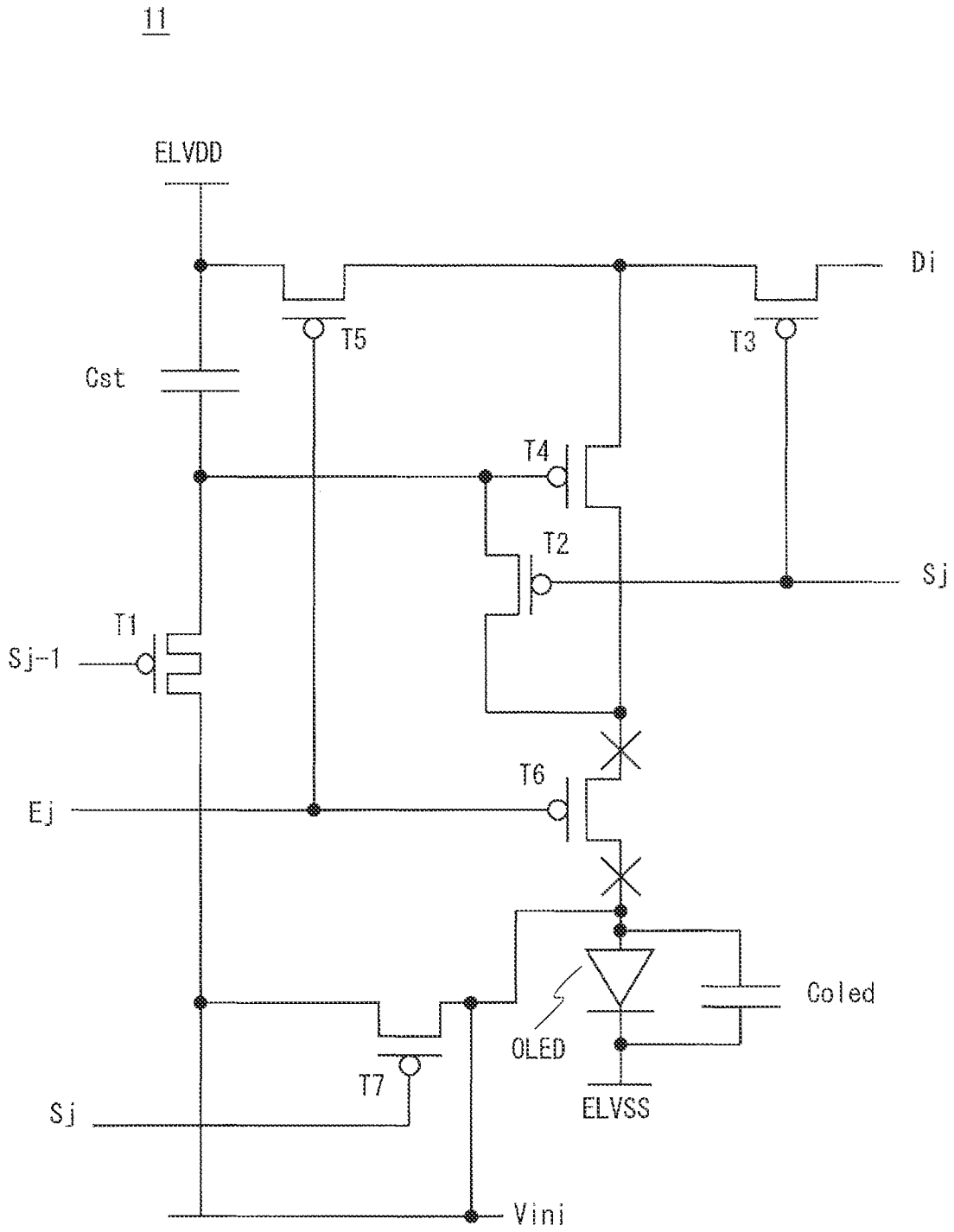
FIG. 16 is a circuit diagram of a pixel circuit according to a second modification example of the second embodiment.

FIG. 16 is a circuit diagram of a pixel circuit 11 according to a second modification example of the present embodiment. As illustrated in FIG. 16, at least either between the first conductive terminal of the light emission control transistor T6 and the second conductive terminal of the drive transistor T4 or between the second conductive terminal of the light emission control transistor T6 and the anode of the organic EL element OLED, a wire formed of a semiconductor layer is fused at a spot added with "x" in FIG. 16. As in the case of the first modification example, the fusing of the wire is performed by irradiating the wire, which is made of the semiconductor layer formed on an insulating substrate, with a laser beam from a back side of the insulating substrate to evaporate the semiconductor layer.

At least either of such wires which sandwich the light emission control transistor T6 is fused, whereby the drive current stops flowing to the organic EL element OLED even if the drive transistor T4 turns to the ON state. As a result, the organic EL element OLED is in the constantly lighting-off state, and accordingly, the pixel circuit 11 is constantly kept black, and in addition, the power consumption thereof is reduced. Note that, in the present modification example, a settable region of the laser irradiation area indicating a spot to be irradiated with the laser beam for fusing the wire is narrow, and accordingly, there can occur a case where the wire cannot be completely fused. Therefore, it is preferable that the present modification example be combined with such a repair to connect the first conductive terminal of the second initialization transistor T7 and the initialization line Vini to each other to turn the pixel circuit 11 into the black dot as described in the first embodiment.

2.6 Third Modification Example

In order to not only turn the pixel circuit 11 into the black dot but also make it possible to surely reduce the power consumption thereof as described above, not only any of the above-described second embodiment, first modification example and second modification example may be applied, but any two among them or all thereof may also be applied at the same time. In any of the cases, the pixel circuit 11 can be turned into the black dot, and in addition, the power consumption when the pixel circuit 11 is to into the black dot can be reduced more surely.

3. Third Embodiment

A third embodiment of the present disclosure will be described. In the present embodiment, a description will be given of a repair that can surely turn the pixel circuit 11 into the black dot not only in a case where the second initialization transistor T7 causes an operation failure as described in the first embodiment, but also in a case where the write transistor T3 causes an operation failure. Note that, since a configuration of the display device, a configuration of the pixel circuit 11 and an operation of the pixel circuit 11 in the present embodiment are individually the same as those in the case described in the first embodiment, a description thereof will be omitted.

With regard to a repair in the case where only the second initialization transistor T7 causes an operation failure, as described in the first embodiment, the first conductive terminal of the second initialization transistor T7 and the initialization line Vini are connected to each other by the irradiation of the laser beam, and the initialization potential Vini is applied to the anode of the organic EL element OLED. Thus, the organic EL element OLED is turned to the constantly lighting-off state, and the pixel circuit 11 is turned to the constantly black dot.

However, only the second initialization transistor T7 causes an operation failure, but also the write transistor T3 stops operating normally in some cases. In consideration of the above, a repair to be performed in such a case will be described.

3.1 Case Where Write Transistor is in Constantly ON State

A description will be given of a problem when the write transistor T3 is in the constantly ON state. If the pixel circuit 11 operates normally, after the initialization period ends, the data signal supplied to the data line Di is written into the node N via the compensation transistor T2 and is given to the gate terminal of the drive transistor T4 during the data writing period. Thus, a current with a current value corresponding to the data signal flows from the high-level power supply line ELVDD to the organic EL element OLED, and the organic EL element OLED emits light with a brightness corresponding to the data signal.

Figure 17:
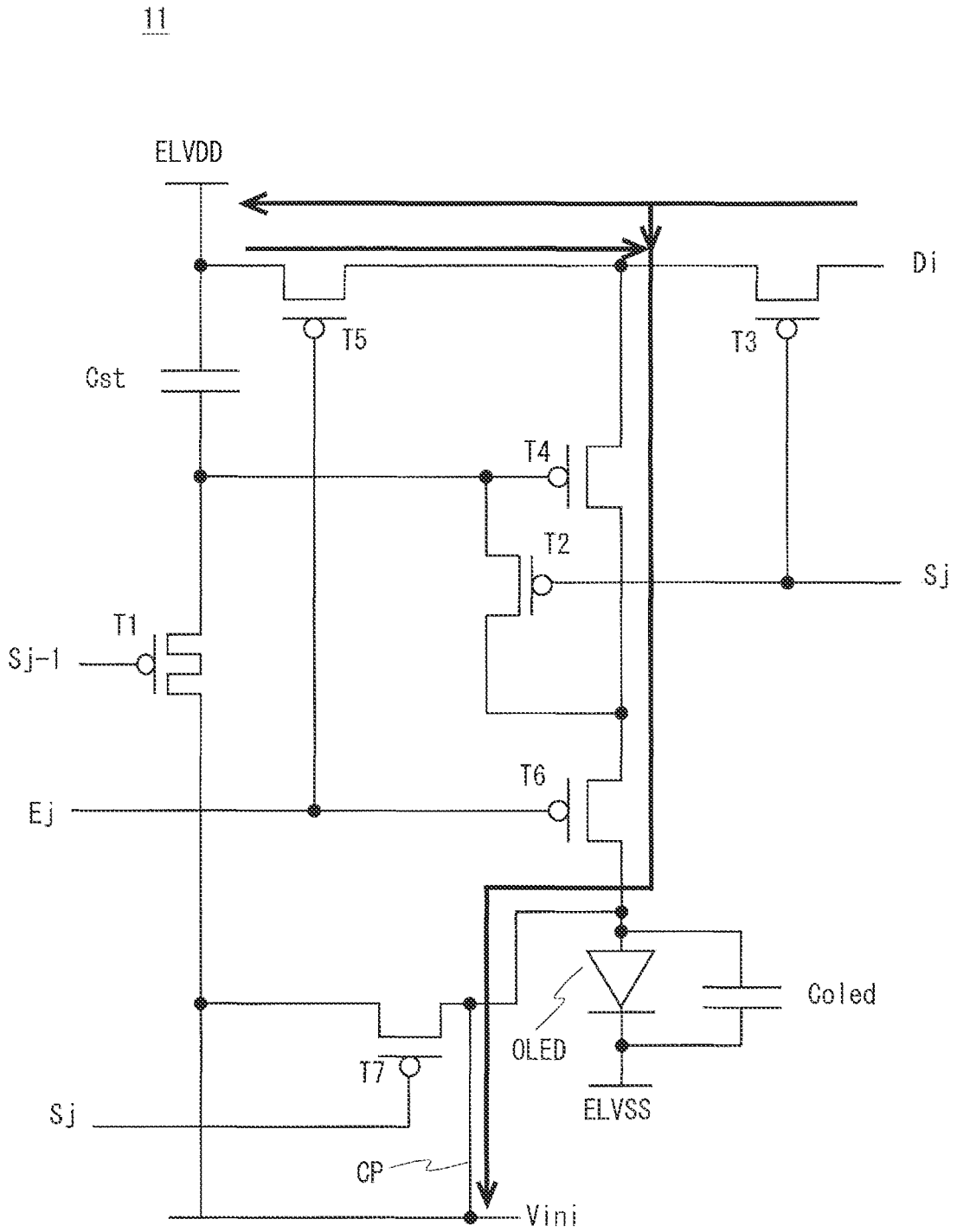
FIG. 17 is a diagram illustrating a problem when a write transistor turns to a constantly ON state in a third embodiment.

A description will be given of a case where, at this time, the write transistor T3 that should be originally in the OFF state is in the ON state due to an operation failure. FIG. 17 is a diagram illustrating a problem when the write transistor T3 turns to the constantly ON state in the present embodiment. As illustrated in FIG. 17, when the drive current flows from the high-level power supply line ELVDD to the organic EL element OLED, a current is supplied also from the data line Di. After passing through the write transistor T3, the current to be supplied from the data line Di branches into a current that goes toward the organic EL element OLED and a current that goes toward the high-level power supply ELVDD. The current that flows toward the organic EL element OLED flows to the initialization line Vini through the connection portion CP formed by the melt described in the first embodiment. In this case, as described in the first embodiment, a voltage to be applied to the organic EL element OLED becomes equal to or less than the threshold voltage, and accordingly, the organic EL element OLED is in the constantly lighting-off state, and the pixel circuit 11 is constantly kept black.

However, the current that goes toward the high-level power supply line ELVDD fluctuates the high-level potential ELVDD of the high-level power supply line ELVDD. Thus, in other pixel circuits connected to the high-level power supply line ELVDD, the abnormal tone occurs by being affected by the fluctuation of the high-level potential ELVDD. When the abnormal tone occurs at the same time in the plurality of pixel circuits connected to the same high-level power supply line ELVDD, a viewer recognizes it as a line defect.

Figure 18:
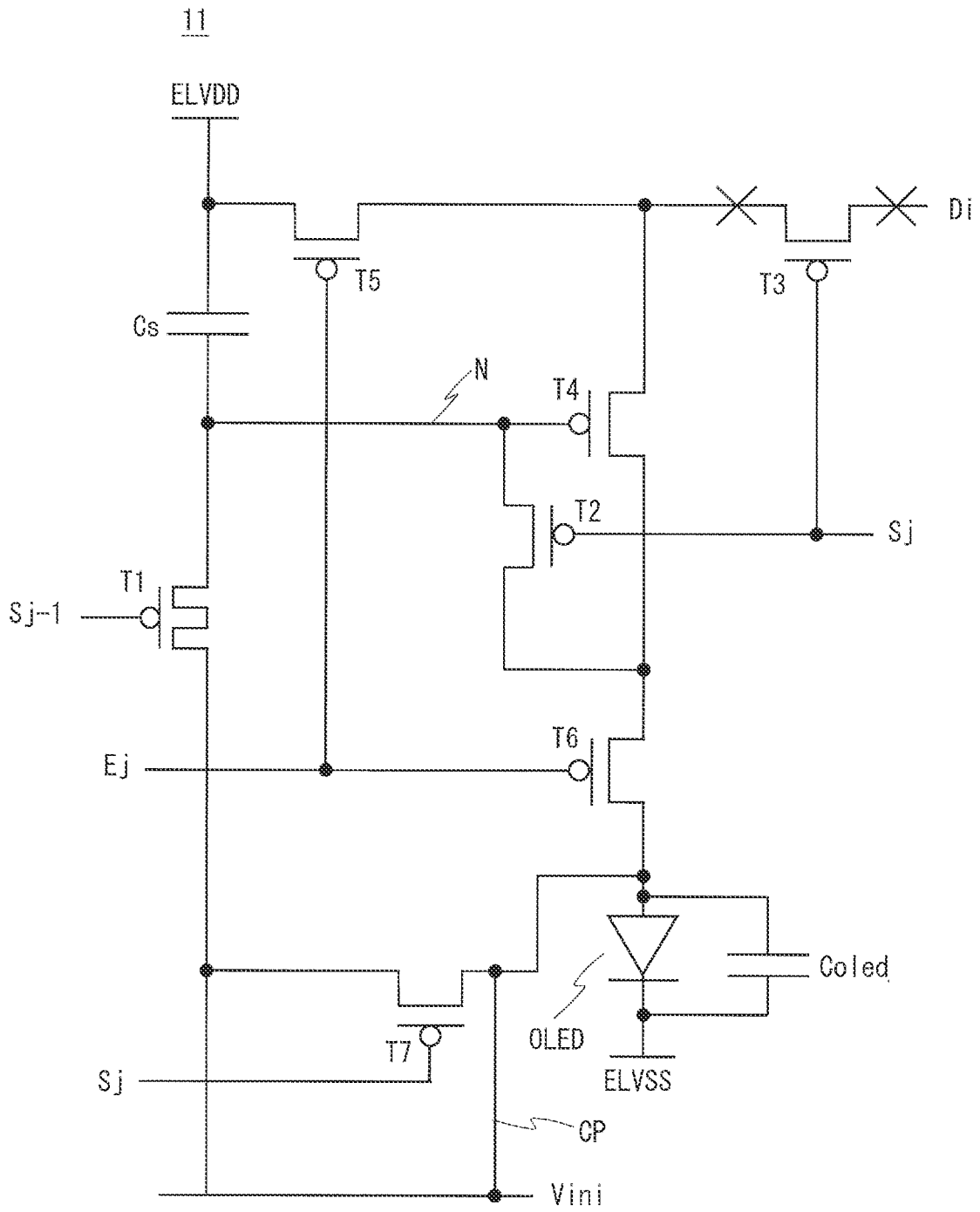
FIG. 18 is a diagram illustrating a configuration of a pixel circuit included in a display device according to the third embodiment, the pixel circuit preventing an occurrence of a line defect.

In consideration of the above, a description will be given of a method for preventing the line defect from occurring in the adjacent pixel circuits 11. FIG. 18 is a diagram illustrating a configuration of a pixel circuit 11 included in a display device according to the present embodiment, the pixel circuit preventing the occurrence of the line defect. In order to prevent a part of the current to be supplied from the data line Di from flowing to the high-level power supply line ELVDD, a wire made of a semiconductor layer close to either the first conductive terminal second conductive terminal of the write transistor T3 is irradiated with the laser beam from the back side of the insulating substrate, whereby the wire is fused, as illustrated in FIG. 18. Thus, the current to be supplied from the data line Di stops flowing to the high-level power supply line ELVDD, and accordingly, the high-level potential ELVDD stops fluctuating. Moreover, the first conductive terminal of the second initialization transistor T7 and the initialization line Vini are connected to each other by the laser melt, whereby the voltage to be applied to the organic EL element OLED becomes equal to or less than the threshold voltage. Accordingly, the organic EL element OLED is in the constantly lighting-off state, and the pixel circuit 11 is constantly kept black. As described above, the pixel circuit 11 of the present embodiment is constantly kept black, and in addition, the line defect can be prevented from being visually recognized in the adjacent pixel circuits 11. However, as in the case of the first embodiment, there is a problem that the power consumption of the pixel circuit 11 is increased when a drive current with a large current value flows therethrough.

3.2 Case Where Write Transistor is in Constantly OFF State

Moreover, in a case where the write transistor T3 is in the constantly OFF state, the initialization potential Vini written in the initialization period is applied to the gate terminal of the drive transistor T4. Thus, when the potential of the emission line Ej turns to the low level in the light emission period, the drive transistor T4 turns to the ON state, and a drive current with a large current value flows from the g-level power supply line ELVDD via the drive transistor T4 to the organic EL element OLED. Therefore, the organic EL element OLED turns on with a high brightness, and the pixel circuit 11 becomes a bright point that is bright.

In consideration of the above, as described in the first embodiment, the first conductive terminal of the second initialization transistor T7 and the initialization line Vini are connected to each other by the connection portion CP. Thus, as described in the first embodiment, the initialization potential Vini is applied to the anode of the organic EL element OLED, whereby the organic EL element OLED is turned to the constantly lighting-off state, and the pixel circuit 11 can be turned to the constantly black dot. However, as in the case of the first embodiment, there is a problem that the power consumption of the pixel circuit 11 is increased since a drive current with a large current value flows therethrough.

3.3 Effect

According to the present embodiment, when the write transistor T3 is in the constantly ON state or the constantly OFF state, the first conductive terminal of the second initialization transistor T7 is connected to the initialization line Vini. Thus, the initialization potential Vini is applied to the anode of the organic EL element OLED, and the voltage to be applied to the organic EL element OLED is set equal to or less than the threshold voltage. As a result, the organic EL element OLED turns to the constantly lighting-off state, and accordingly, the pixel circuit 11 can be turned to the constantly black dot.

Moreover, in a case where the write transistor T3 is in the constant ON state, in order to prevent a part of the current to be supplied from the data line Di from flowing to the high-level power supply line ELVDD, a wire made of a semiconductor layer close to either the first conductive terminal second conductive terminal of the write transistor T3 is fused. Thus, the current to be supplied from the data line Di stops flowing to the high-level power supply line ELVDD, and accordingly, the high-level potential ELVDD stops fluctuating, and the line defect stops being visually recognized in the adjacent pixels.

3.4 Modification Example

Also in the case of the third embodiment, as in the case of the second embodiment, the drive current flows through the small ON-resistance power supply transistor T5, drive transistor T4 and light emission control transistor T6, and accordingly, a current value thereof is increased. Therefore, there is a problem that the power consumption of the pixel circuit 11 is increased. Accordingly, in order to reduce the power consumption of the pixel circuit 11, any one, any two or all of the methods described in the second embodiment, the first modification example and the second modification example may be further applied to the pixel circuit 11.

DESCRIPTION OF REFERENCE CHARACTERS

10: DISPLAY UNIT
11: PIXEL CIRCUIT
CH: CONTACT HOLE (OPENING PART)
T1: FIRST INITIALIZATION TRANSISTOR
T2: COMPENSATION TRANSISTOR
T21: FIRST COMPENSATION TRANSISTOR
T22: SECOND COMPENSATION TRANSISTOR
T3: WRITE TRANSISTOR
T4: DRIVE TRANSISTOR
T5: POWER SUPPLY TRANSISTOR
T6: LIGHT EMISSION CONTROL TRANSISTOR
T7: SECOND INITIALIZATION TRANSISTOR
OLED: ORGANIC EL ELEMENT (ELECTRO-OPTICAL ELEMENT)
SI: SEMICONDUCTOR LAYER
CW: CONNECTION WIRE
REP: REPAIR WIRE
Di: DATA LINE
SCAN: SCANNING LINE
Vini: INITIALIZATION POTENTIAL, INITIALIZATION LINE
ELVDD: HIGH-LEVEL POTENTIAL, HIGH-LEVEL POWER SUPPLY LINE (FIRST POWER SUPPLY LINE)
ELVSS: LOW-LEVEL POTENTIAL, LOW-LEVEL POWER SUPPLY LINE (SECOND POWER SUPPLY LINE)
OFVDD: OFF-STATE VOLTAGE SUPPLY LINE
SP: CONNECTION POINT (OF FIRST COMPENSATION TRANSISTOR AND SECOND COMPENSATION TRANSISTOR)

The invention claimed is:

1. A display device that displays an image by supplying a data signal individually to a plurality of pixel circuits arranged on a display panel, the display device comprising:
- a plurality of data lines to which the data signal is supplied;
- a plurality of scanning lines to which scanning signals for selecting the plurality of pixel circuits are sequentially supplied, the plurality of pixel circuits provided so as to correspond to intersections of the plurality of data lines and the plurality of scanning lines;
- a scanning line drive circuit configured to sequentially select the plurality of scanning lines; and
- a data line drive circuit configured to supply the data signal to the plurality of data lines, wherein each of the plurality of pixel circuits includes:
- an electro-optical element;
- a drive transistor for supplying a drive current corresponding to the data signal to the electro-optical element;
- a compensation transistor for compensating for a threshold voltage of the drive transistor by writing the data signal that is given by a corresponding data line to a node connected to a control terminal of the drive transistor;
- an initialization line configured to supply an initialization potential;
- a first initialization transistor that has a first conductive terminal connected to the node and a second conductive terminal connected to the initialization line; and
- a second initialization transistor that has a first conductive terminal connected to a first electrode of the electro-optical element and a second conductive terminal connected to the initialization line, wherein
- the plurality of pixel circuits includes a first pixel circuit configured to display a bright point with a brightness corresponding to the data signal and a second pixel circuit configured to constantly display a black dot, and
- in the second pixel circuit, the first conductive terminal of the second initialization transistor and the initialization line are electrically connected to each other.

2. The display device according to claim 1, wherein, in the second pixel circuit, in a region where a semiconductor layer as the first conductive terminal of the second initialization transistor and the initialization line intersect each other, the semiconductor layer and at least a part of the initialization line are electrically connected to each other.

3. The display device according to claim 2, wherein
- the display panel is a panel in which the semiconductor layer, a gate insulating film, a first display wiring layer, a first inorganic insulating film, and a second display wiring layer are sequentially laminated,
- the first conductive terminal of the second initialization transistor is made of the semiconductor layer, and
- the initialization line is made of the second display wiring layer.

4. The display device according to claim 3, wherein
- the display panel is a panel in which a second inorganic insulating film and a third display wiring layer are further sequentially laminated on the second wiring layer, and
- a connection wire that electrically connects the initialization line and the semiconductor layer to each other is made of the third display wiring layer.

5. The display device according to claim 1, further comprising a connection wire electrically connected to the initialization line, wherein, in the second pixel circuit, by the connection wire electrically connecting to the first conductive terminal of the second initialization transistor in a region where the connection wire intersects with a semiconductor layer as the first conductive terminal of the second initialization transistor, the initialization line and the first conductive terminal of the second initialization transistor are electrically connected to each other.

6. The display device according to claim 1, further comprising:
- a first power supply line configured to supply a first power supply potential; and
- an off-state voltage supply line electrically connected to the first power supply line, wherein
- the compensation transistor is a transistor with a dual gate structure including a first compensation transistor and a second compensation transistor, the transistor with the dual gate structure being formed on a semiconductor layer that connects the node and a second conductive terminal of the drive transistor to each other, a second conductive terminal of the first compensation transistor and a first conductive terminal of the second compensation transistor are connected to each other via a connection point of the semiconductor layer, the connection point being sandwiched between the first compensation transistor and the second compensation transistor, a second conductive terminal of the second compensation transistor is connected to the node, a control terminal of the first compensation transistor and a control terminal of the second compensation transistor are connected to one of the plurality of scanning lines, the off-state voltage supply line is formed to be superimposed on the connection point of the semiconductor layer with an insulating film interposed therebetween, and in the second pixel circuit, the connection point of the semiconductor layer is electrically connected to the off-state voltage supply line.

7. The display device according to claim 6, wherein, in the second pixel circuit, either a wire that connects the first conductive terminal of the first initialization transistor and the node to each other or a wire that connects the second conductive terminal of the first initialization transistor and the initialization line to each other is electrically separated.

8. The display device according to claim 6, wherein each of the plurality of pixel circuits includes a light emission control transistor configured to control the drive current to be flowed to the electro-optical element, and in the second pixel circuit, either a wire that connects a first conductive terminal of the light emission control transistor and the second conductive terminal of the drive transistor to each other or a wire that connects a second conductive terminal of the light emission control transistor and the first electrode of the electro-optical element to each other is electrically separated.

9. The display device according to claim 6, wherein each of the plurality of pixel circuits includes a write transistor connected to a corresponding data line and configured to write the data signal from the corresponding data line into the node, and in the second pixel circuit, either a wire between a first conductive terminal of the write transistor and the data line or a wire between a second conductive terminal of the write transistor and a first conductive terminal of the drive transistor is electrically separated.

10. A method for manufacturing a display device that displays an image by supplying a data signal individually to a plurality of pixel circuits formed on a display panel, wherein each of the plurality of pixel circuits includes:

an electro-optical element that emits light with a brightness corresponding to a current value of a drive current corresponding to the data signal;

a drive transistor for supplying the drive current to the electro-optical element;

a compensation transistor for compensating for a threshold voltage of the drive transistor by writing the data signal that is given from a data line into a node connected to a control terminal of the drive transistor;

an initialization line configured to supply an initialization potential;

a first initialization transistor that has a first conductive terminal connected to the node and a second conductive terminal connected to the initialization line; and a second initialization transistor that has a first conductive terminal connected to a first electrode of the electro-optical element and a second conductive terminal connected to the initialization line, the method comprising:

electrically connecting the first conductive terminal of the second initialization transistor and the initialization line to each other by irradiating at least a part of a region where, in at least one pixel circuit among the plurality of pixel circuits, the first conductive terminal of the second initialization transistor is superimposed on the initialization line with a laser beam from a back side of the display panel.

11. The method for manufacturing the display device according to claim 10, wherein the display device further includes a first power supply line configured to supply a first power supply potential and an off-state voltage supply line electrically connected to the first power supply line, the plurality of pixel circuits includes a first pixel circuit configured to display a bright point with a brightness corresponding to the data signal, and a second pixel circuit configured to constantly display a black dot, the compensation transistor is a transistor with a dual gate structure including a first compensation transistor and a second compensation transistor, the transistor with the dual gate structure being formed on a semiconductor layer that connects the node and a second conductive terminal of the drive transistor to each other, a second conductive terminal of the first compensation transistor and a first conductive terminal of the second compensation transistor are connected to each other via a connection point of the semiconductor layer, the connection point being sandwiched between the first compensation transistor and the second compensation transistor, a second conductive terminal of the second compensation transistor is connected to the node, a control terminal of the first compensation transistor and a control terminal of the second compensation transistor are connected to one of the plurality of scanning lines, the off-state voltage supply line is formed to be superimposed on the connection point with an insulating film interposed therebetween, the method further comprising:

in the at least one pixel circuit, electrically connecting the connection point and the off-state voltage supply line to each other by irradiating a region where the connection point is superimposed on the off-state voltage supply line with a laser beam.

12. A method for manufacturing a display device that displays an image by supplying a data signal individually to a plurality of pixel circuits formed on a display panel, wherein each of the plurality of pixel circuits includes:

an electro-optical element that emits light with a brightness corresponding to a current value of a drive current corresponding to the data signal;

a drive transistor for supplying the drive current to the electro-optical element;

a compensation transistor for compensating for a threshold voltage of the drive transistor by writing the data signal that is given from a data line into a node connected to a control terminal of the drive transistor;

an initialization line configured to supply an initialization potential;

a first initialization transistor that has a first conductive terminal connected to the node and a second conductive terminal connected to the initialization line;

a second initialization transistor that has a first conductive terminal connected to a first electrode of the electro-optical element and a second conductive terminal connected to the initialization line; and a connection wire electrically connected to the initialization line and formed to be superimposed on a semiconductor layer as the first conductive terminal of the second initialization transistor with an insulating film interposed between the connection wire and the semiconductor layer, the method comprising:

in at least one pixel circuit among the plurality of pixel circuits, electrically connecting the first conductive terminal of the second initialization transistor and the initialization line to each other by electrically connecting the first conductive terminal of the second initialization transistor and the connection wire to each other through irradiating at least a part of a region where the connection wire is superimposed on the semiconductor layer with a laser beam from a back side of the display panel.

* * * * *